US009216600B2

(12) United States Patent
Ishikawa et al.

(10) Patent No.: US 9,216,600 B2
(45) Date of Patent: Dec. 22, 2015

(54) PRINTER WITH PRESENTER UNIT FOR PAPER DISCHARGE AND RECOVERY

(71) Applicant: FUJITSU COMPONENT LIMITED, Tokyo (JP)

(72) Inventors: Tetsuhiro Ishikawa, Tokyo (JP); Sumio Watanabe, Tokyo (JP); Yukihiro Mori, Tokyo (JP); Masaru Kihara, Tokyo (JP); Masahiro Tsuchiya, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 14/479,431

(22) Filed: Sep. 8, 2014

(65) Prior Publication Data

US 2014/0374981 A1 Dec. 25, 2014

Related U.S. Application Data

(63) Continuation of application No. PCT/JP2013/054057, filed on Feb. 12, 2013.

(30) Foreign Application Priority Data

Mar. 14, 2012 (JP) ..... 2012-058007

(51) Int. Cl.
*B41J 11/70* (2006.01)
*B41J 13/03* (2006.01)
(Continued)

(52) U.S. Cl.
CPC ..... *B41J 13/106* (2013.01); *B41J 11/663* (2013.01); *B41J 11/70* (2013.01); *B41J 13/0045* (2013.01); *B41J 15/04* (2013.01); *B41J 29/60* (2013.01);
(Continued)

(58) Field of Classification Search
CPC ..... B65H 2408/13; B65H 29/60; B65H 2404/1521; B65H 2404/1532; B41J 11/70; B41J 13/106
See application file for complete search history.

(56) References Cited

U.S. PATENT DOCUMENTS 5,201,517 A * 4/1993 Stemmle ..... 271/291
5,210,616 A * 5/1993 Kawasaki et al. ..... 358/296
(Continued)

FOREIGN PATENT DOCUMENTS

JP 63143162 A * 6/1988 ..... B65H 29/60
JP S63-143162 6/1988
(Continued)

OTHER PUBLICATIONS

PCT International Search Report; Written Opinion for PCT/JP2013/054057; mailed Mar. 19, 2013.*
(Continued)

*Primary Examiner* — Daniel J Colilla
(74) *Attorney, Agent, or Firm* — IPUSA, PLLC

(57) ABSTRACT

A printer apparatus includes a presenter unit including a first roller and a second roller connected to the first roller by a connection arm to move along an outer periphery of the first roller in accordance with the rotation of the first roller between a first rotating position and a second rotating position, rotate at the first rotating position in accordance with the rotation of the first roller to transfer a cut printed recording paper in an ejecting direction while interposing with the first roller, and rotate at the second rotating position in accordance with the rotation of the first roller to transfer the cut printed recording paper in a recovering direction while interposing with the first roller.

15 Claims, 19 Drawing Sheets

(51) Int. Cl.

| | |
|---|---|
| ***B65H 29/60*** | (2006.01) |
| ***B41J 13/10*** | (2006.01) |
| ***B41J 29/60*** | (2006.01) |
| ***B41J 13/00*** | (2006.01) |
| ***B41J 15/04*** | (2006.01) |
| ***B65H 29/12*** | (2006.01) |
| ***G07F 19/00*** | (2006.01) |
| ***G07G 5/00*** | (2006.01) |
| ***B41J 11/66*** | (2006.01) |
| ***B65H 20/02*** | (2006.01) |

(52) U.S. Cl.

CPC ..... *B65H 20/02* (2013.01); *B65H 29/12* (2013.01); *G07F 19/201* (2013.01); *G07G 5/00* (2013.01); *B65H 2403/942* (2013.01); *B65H 2404/1521* (2013.01); *B65H 2404/1532* (2013.01); *B65H 2404/262* (2013.01); *B65H 2408/13* (2013.01); *B65H 2513/412* (2013.01); *B65H 2513/42* (2013.01); *B65H 2513/50* (2013.01); *B65H 2701/1936* (2013.01)

(56) References Cited

U.S. PATENT DOCUMENTS

| | | | | |
|---|---|---|---|---|
| 5,377,586 | A | 1/1995 | Matsuno | |
| 5,850,075 | A | 12/1998 | Brannan et al. | |
| 6,318,917 | B1 * | 11/2001 | Taylor | 400/613 |
| 6,371,481 | B1 * | 4/2002 | Miyake | 271/314 |
| 6,814,515 | B2 | 11/2004 | Tsuchiya et al. | |
| 7,857,534 | B2 | 12/2010 | Watanabe et al. | |
| 2007/0274758 | A1 | 11/2007 | Baitz et al. | |
| 2014/0327205 | A1 * | 11/2014 | Ishikawa et al. | 270/1.01 |

FOREIGN PATENT DOCUMENTS

| | | |
|---|---|---|
| JP | H07-117912 | 5/1995 |
| JP | 2003-019845 | 1/2003 |
| JP | 2004-315142 | 11/2004 |
| JP | 2007-130842 | 5/2007 |

OTHER PUBLICATIONS

International Search Report mailed on Mar. 19, 2013.

* cited by examiner

START PRINTING
S102
PRESENTER UNIT?
NO
YES
END
S104
RECEIVING RECORDING PAPER
S106
NORMALLY COMPLETED?
NO
YES
S108
PRE-EJECTION OPERATION
S110
NORMALLY COMPLETED?
NO
YES
S112
FLAG TO EJECT RECORDING PAPER ON?
NO
YES
S114
EJECTION OPERATION
S116
NORMALLY COMPLETED?
NO
YES
S118
FLAG TO RECOVER RECORDING PAPER ON?
NO
YES
S120
RECOVERING OPERATION
S122
NORMALLY COMPLETED?
NO
YES
END
ERROR AND END

PRINTER WITH PRESENTER UNIT FOR PAPER DISCHARGE AND RECOVERY

CROSS-REFERENCE TO RELATED APPLICATION

This application is a continuation application filed under 35 U.S.C. 111(a) claiming the benefit under 35 U.S.C. 120 and 365(c) of PCT International Application No. PCT/JP2013/054057 filed on Feb. 12, 2013, which is based upon and claims the benefit of priority of Japanese Priority Application No. 2012-058007 filed on Mar. 14, 2012, the entire contents of which are hereby incorporated by reference.

BACKGROUND OF THE INVENTION

1. Field of the Invention

The present invention relates to a printer apparatus and a method of controlling the printer apparatus.

2. Description of the Related Art

A printer apparatus that issues a sales slip or the like is widely used at a cash register in a shop, an Automated Teller Machine (ATM) or a cash dispenser of a bank or the like. In such a printer apparatus that issues the sales slip or the like, a thermal paper, which is a recording paper, is provided in a rolled state, an image or the like is printed on the recording paper by a thermal head or the like while transferring the recording paper, and the printed recording paper is transferred to a predetermined position where the recording paper is cut with a predetermined length.

In such a printer apparatus, a presenter unit that manages a recording medium after being printed (which will be referred to as a "printed recording medium" or a "printed recording paper") is provided. With the function of the presenter unit, the recording paper is kept so as not be pulled out while being printed or being cut by a cutter. By providing such a presenter unit, the printed recording paper is introduced into the presenter unit and is ejected from the presenter unit after being cut.

Further, for the presenter unit, a retractor function may be provided by which the ejected printed recording paper, in other words the sales slip or the like, is recovered when the ejected printed recording paper is not taken by a proper user for a predetermined period. With this function, the ejected printed recording paper is not taken by others.

Here, there are various kinds of devices having the presenter function and the retractor function. For example, there is a type in which the printed recording paper is wound around a rolled member or the like and then cut by a cutter to be ejected. However, with such a conventional method, the mechanism of the rolled member may be complicated and the size of the device may be large.

Further, for example, there is a type in which a timing belt or the like is used in a unit having the presenter function or the retractor function as a transfer belt. However, the timing belt or the like is made of a rubber or the like. Thus, the timing belt or the like may extend while using it for a long time causing a reduction in power for transferring the recording paper. In such a case, it is impossible to transfer the recording paper to a desired position.

PATENT DOCUMENT

[Patent Document 1] Japanese Laid-open Patent Publication No. 2003-19845

[Patent Document 2] Japanese Laid-open Patent Publication No. 2007-130842

[Patent Document 3] Japanese Laid-open Patent Publication No. 2004-315142

SUMMARY OF THE INVENTION

According to an embodiment, there is provided a printer apparatus including a printing unit that prints an image on a recording paper; a platen roller that transfers the recording paper; a cutter unit that cuts the printed recording paper on which the image is formed by the printing unit; and a presenter unit configured to eject and recover the cut printed recording paper cut by the cutter unit, the presenter unit including a first roller that is rotated in a first direction for ejecting the cut printed recording paper and a second direction opposite to the first direction for recovering the cut printed recording paper, a second roller, and a connection arm that connects the centers of the first roller and the second roller while pushing the second roller toward the first roller to have the second roller move along an outer periphery of the first roller in accordance with the rotation of the first roller between a first rotating position and a second rotating position, rotate at the first rotating position in accordance with the rotation of the first roller to transfer the cut printed recording paper in an ejecting direction while interposing with the first roller when the first roller is rotated in the first direction, and rotate at the second rotating position in accordance with the rotation of the first roller to transfer the cut printed recording paper in a recovering direction while interposing with the first roller when the first roller is rotated in the second direction.

According to another embodiment, there is provided a method of controlling the printer apparatus, including ejecting the cut printed recording paper by rotating the first roller in the first direction so that the second roller is rotated in accordance with the first roller at the first rotating position until a front end portion of the cut printed recording paper is transferred to a predetermined position while the back end portion of the cut printed recording paper is interposed between the first roller and the second roller, determining whether to perform a recovering operation after a predetermined period has passed from a timing when the cut printed recording paper is transferred to the predetermined position, and recovering the cut printed recording paper, when it is determined to perform the recovering operation, by rotating the first roller in the second direction so that the second roller is rotated in accordance with the first roller at the second rotating position.

BRIEF DESCRIPTION OF THE DRAWINGS

Other objects, features and advantages of the present invention will become more apparent from the following detailed description when read in conjunction with the accompanying drawings.

DETAILED DESCRIPTION OF THE PREFERRED EMBODIMENTS

Figure 1:
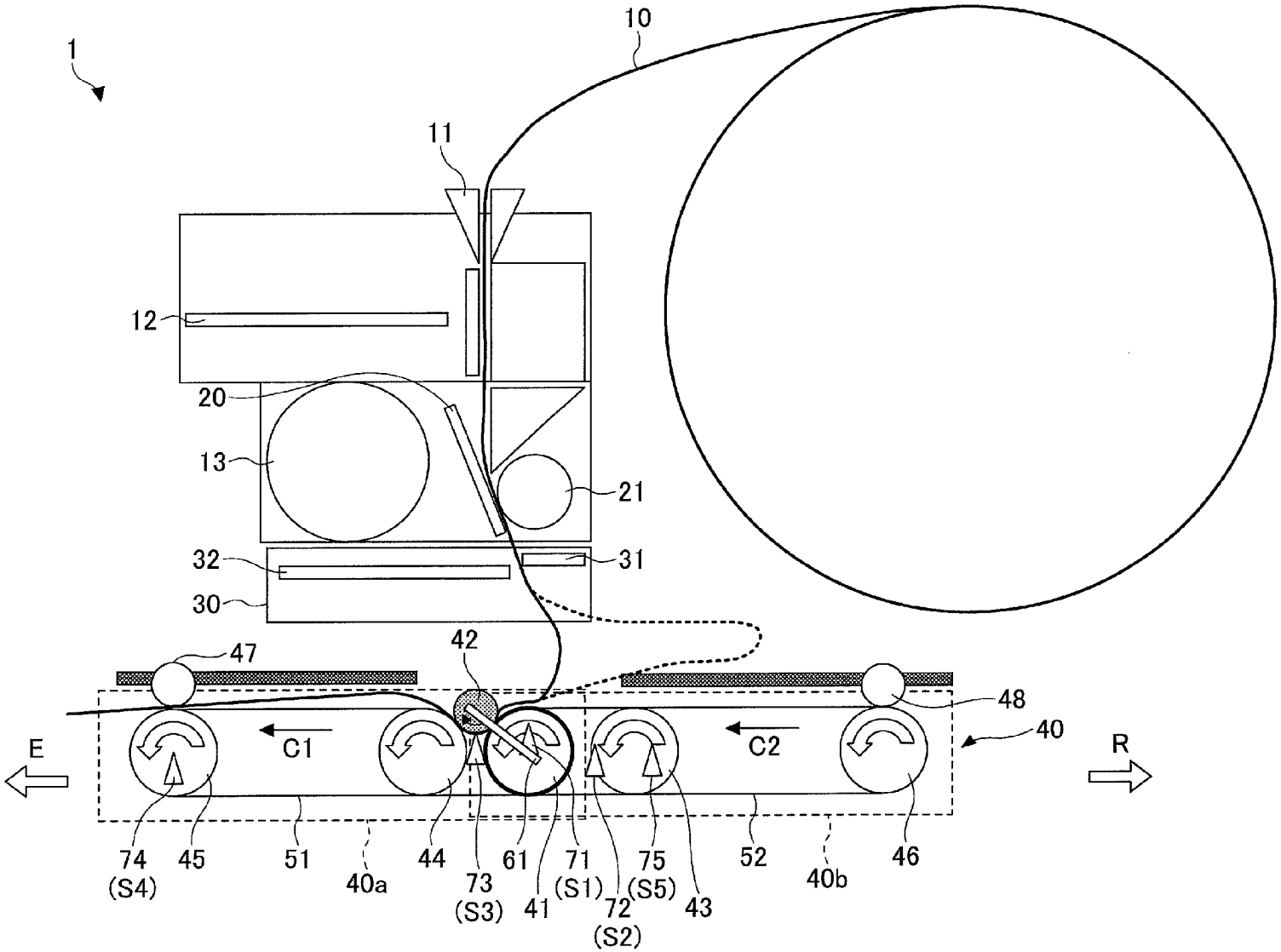
FIG. 1 is a view showing an example of a printer apparatus of a first embodiment.

The invention will be described herein with reference to illustrative embodiments. Those skilled in the art will recognize that many alternative embodiments can be accomplished using the teachings of the present invention and that the invention is not limited to the embodiments illustrated for explanatory purposes.

It is to be noted that, in the explanation of the drawings, the same components are given the same reference numerals, and explanations are not repeated.

First Embodiment

Structure of Printer Apparatus

FIG. 1 is a schematic view showing an example of a printer apparatus 1 of the first embodiment. The structure of the printer apparatus 1 of the embodiment is explained with reference to FIG. 1.

The printer apparatus 1 includes a recording paper damper 11, a control substrate 12, a motor 13, a thermal head 20, a platen roller 21, a cutter unit 30, and a presenter unit 40.

The thermal head 20 prints an image or the like on a recording paper 10, which is in a rolled form. The cutter unit 30 cuts the recording paper 10 on which the image or the like is printed (which will be referred to as a "printed recording paper") with a predetermined length. The recording paper 10 is a thermal paper or the like. The recording paper 10 is inserted between the thermal head 20 and the platen roller 21 via the recording paper damper 11. Then, while being interposed between the thermal head 20 and the platen roller 21, the image or the like is printed on the recording paper 10 by the thermal head 20.

The cutter unit 30 includes a fixed blade 31 and a movable blade 32. The recording paper 10 on which the characters or the like are printed is cut with the predetermined length when the movable blade 32 is moved with respect to the fixed blade 31.

The control substrate 12 controls printing, ejecting, recovering of the recording paper 10 or the like. The motor 13 is provided for transferring the recording paper 10.

The presenter unit 40 is provided outside of the cutter unit 30 for ejecting the printed recording paper 10 or the like. The presenter unit 40 has a presenter function and a retractor (recovering) function. Specifically, the presenter unit 40 includes a presenter function unit 40*a* and a retractor function unit 40*b*.

In this embodiment, the presenter unit 40 is configured to include a drive roller 41 (an example of a first roller), a pinch roller 42 (an example of a second roller), and a connection arm 61. These components function as both the presenter function unit 40*a* and the retractor function unit 40*b*.

The drive roller 41 is rotated in a first direction for ejecting the printed recording paper 10 after being cut by the cutter unit 30 (which will be referred to as a "cut printed recording paper") and a second direction opposite to the first direction for recovering the cut printed recording paper 10. The pinch roller 42 is capable of being rotated in accordance with the rotation of the drive roller 41. The connection arm 61 connects the centers of the drive roller 41 and the pinch roller 42 while pushing the pinch roller 42 toward the drive roller 41 to have the pinch roller 42 move along an outer periphery of the drive roller 41 in accordance with the rotation of the drive roller 41.

The presenter unit 40 is configured such that the movement of the pinch roller 42 along the outer periphery of the drive roller 41 is stopped at a first rotating position when the drive roller 41 is rotated in the first direction at which point the pinch roller 42 interposes and transfers the cut printed recording paper 10 with the drive roller 41 in an ejecting direction E in accordance with the rotation of the drive roller 41. The presenter unit 40 is configured such that the movement of the pinch roller 42 along the outer periphery of the drive roller 41 is stopped at a second rotating position when the drive roller 41 is rotated in the second direction at which point the pinch roller 42 interposes and transfers the cut printed recording paper with the drive roller 41 in a recovering direction R in accordance with the rotation of the drive roller 41.

The presenter unit 40 includes a first stopper member and a second stopper member to stop the movement of the pinch roller 42 at the first rotating position and the second rotating position, respectively.

The presenter function unit 40*a* includes the drive roller 41, the pinch roller 42, a first transfer belt 51, a fourth roller 44, a fifth roller 45, and a first pinch roller 47. The first transfer belt 51 is hung around the drive roller 41, the fourth roller 44, and the fifth roller 45. The first transfer belt 51 is interposed between the first pinch roller 47 and the fifth roller 45.

In this embodiment, the fourth roller 44 functions as the first stopper member. FIG. 1 shows a state when the movement of the pinch roller 42 along the outer periphery of the drive roller 41 is stopped at the first rotating position. At this time, the first transfer belt 51 is interposed between the pinch roller 42 and the drive roller 42 and between the pinch roller 42 and the fourth roller 44.

The retractor function unit 40*b* includes the drive roller 41, the pinch roller 42, a second transfer belt 52, a third roller 43, a sixth roller 46, and a second pinch roller 48. The second transfer belt 52 is hung round the drive roller 41, the third roller 43, and the sixth roller 46. These components compose a retractor function unit 40*b*. The second transfer belt 52 is interposed between the second pinch roller 48 and the sixth roller 46.

Figure 5A:
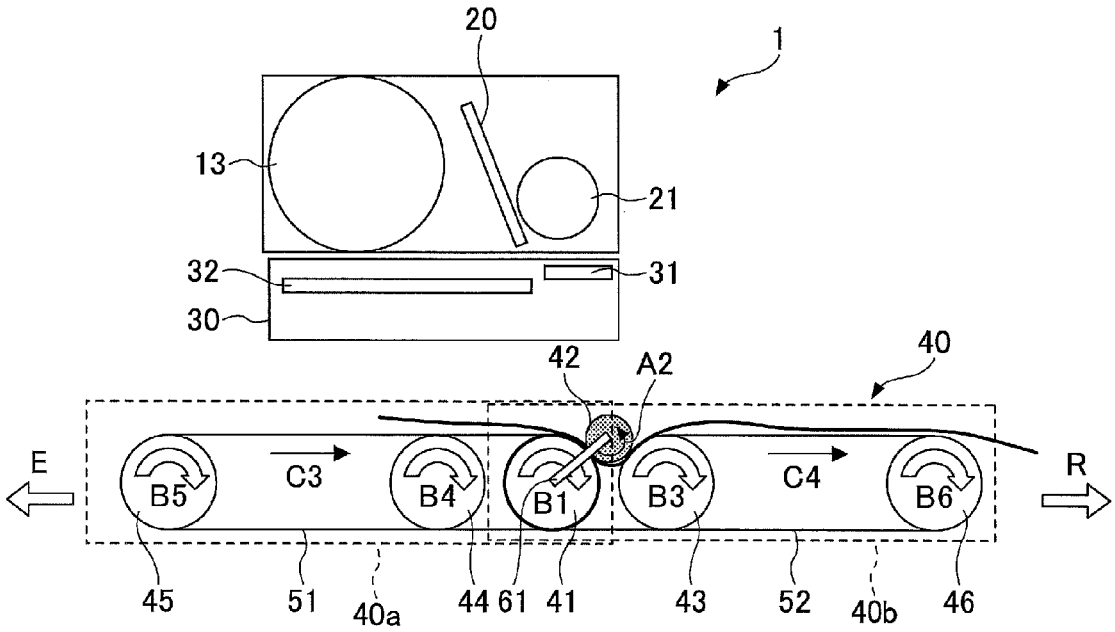
FIG. 5A and FIG. 5B are views for explaining the example of the operation of the presenter unit of the first embodiment.
Figure 5B:
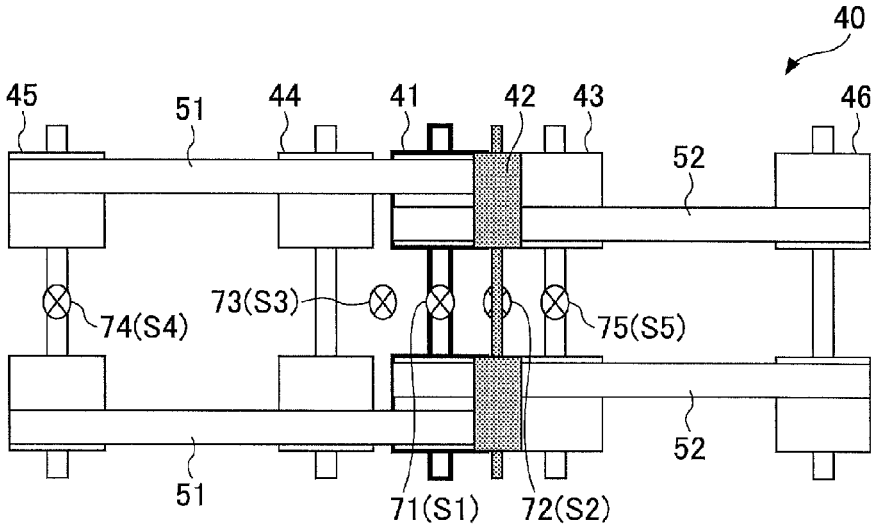

In this embodiment, the third roller 43 functions as the second stopper member. As will be explained later, FIG. 5A and FIG. 5B show a state when the movement of the pinch roller 42 along the outer periphery of the drive roller 41 is stopped at the second rotating position. At this time, the second transfer belt 52 is interposed between the pinch roller 42 and the drive roller 41 and between the pinch roller 42 and the third roller 43.

The first transfer belt 51 and the second transfer belt 52 may be timing belts or the like. Alternatively, as long as the first transfer belt 51 and the second transfer belt 52 can transfer the recording paper 10, any other transfer belts or the like may be used.

Figure 2:
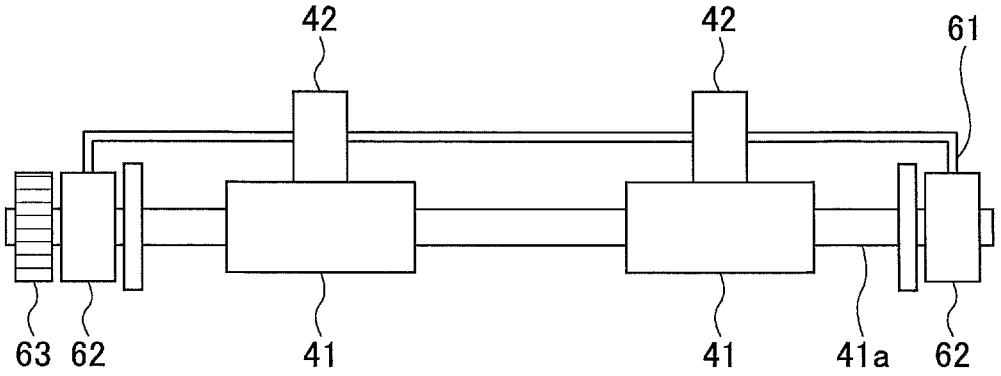
FIG. 2 is a view showing an example of a drive roller and a pinch roller.

FIG. 2 is a side view showing an example of the drive roller 41 and the pinch roller 42.

The connection arm 61 is configured to push the pinch roller 42 toward the drive roller 41. For example, the connection arm 61 may be made of an elastic member such as a spring or the like so that a force having the drive roller 41 and the pinch roller 42 be closer to each other is applied. In this embodiment, as shown in FIG. 2, the connection arm 61 includes a torque limiter 62 (an example of an energizing member). The presenter unit 40 further includes a drive gear 63.

The connection arm 61 is connected to the drive roller 41 via the torque limiter 62. By connecting the connection arm 61 via the torque limiter 62, the connection arm 61 synchronously moves with the rotation of the drive roller 41 in the rotation direction, and when a force more than or equal to a predetermined value is applied to the pinch roller 42, only the rotation shaft 41*a* slips while maintaining the status in which the force is applied to the pinch roller 42.

Further, as shown in FIG. 2, the drive roller 41 may include plural rollers provided in a width direction of the recording paper 10 and configured to be rotated with a rotation shaft 41*a*. Similarly, the pinch roller 42 may include plural rollers provided in the width direction of the recording paper 10 to correspond to the rollers of the drive roller 41, respectively. Here, the first transfer belt 51 and the second transfer belt 52 are not shown in FIG. 2.

The drive gear 63 is connected to the rotation shaft 41*a* of the first roller 41. The rotation of the rotation force from the motor is transmitted to the first roller 41 via the drive gear 63 and other gears not shown in the drawings under a control of the control substrate 12 or the like. The transferring speed of the recording paper 10 by the first roller 41 is set to be slower than or equal to that by the platen roller 21. With this structure, the recording paper 10 is not drawn between the first roller 41 and the platen roller 21, so that misprinting is avoided. Thus, the recording paper 10 may be loosened as shown by a dotted line in FIG. 1 between the platen roller 21 and the drive roller 41. In this embodiment, the torque limiter 62 may be configured to be capable of rotating the pinch roller 42 in accordance with the rotation of the drive roller 41 and being applied with a force by the pinch roller 42 which is moved in accordance with the rotation of the drive roller 41.

As shown in FIG. 1, the pinch roller 42 is provided at the outer periphery of the drive roller 41 through the first transfer belt 51 or the second transfer belt 52. With this structure, the pinch roller 42 is capable of rotating around the drive roller 41 within a predetermined range through the first transfer belt 51 or the second transfer belt 52.

The printer apparatus 1 further includes sensors, a first sensor 71 (S1), a second sensor (S2), a third sensor 73 (S3), a fourth sensor 74 (S4), and a fifth sensor 75 (S5), for detecting an existence of the recording paper 10.

Specifically, as shown in FIG. 1, the first sensor 71 (S1) is provided in the vicinity of the drive roller 41. The second sensor 72 (S2) is provided between the drive roller 41 and the third roller 43. The third sensor 73 (S3) is provided between the drive roller 41 and the fourth roller 44. The fourth sensor 74 (S4) is provided in the vicinity of the fifth roller 45. The fifth sensor 75 (S5) is provided in the vicinity of the third roller 43.

(Operation of Printer Apparatus)

An operation of the printer apparatus 1 is explained.

With reference to FIG. 1, in the printer apparatus 1 of the embodiment, after the image or the like is printed on the recording paper 10 by the thermal head 20, the printed recording paper 10 is cut by the cutter unit 30 with a desired width.

Figure 3A:
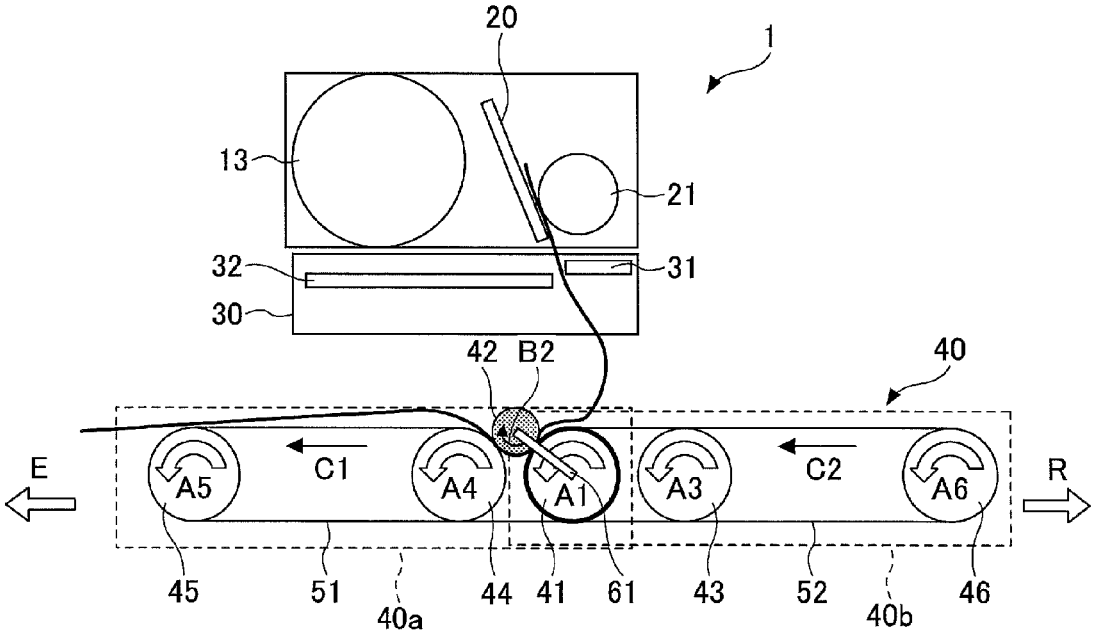
FIG. 3A and FIG. 3B are views for explaining an example of the operation of a presenter unit of the first embodiment.
Figure 3B:
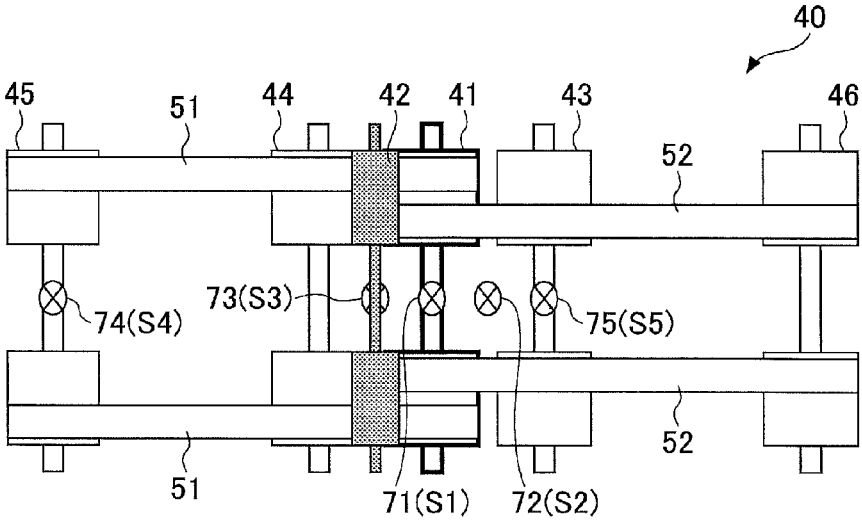

FIG. 3A and FIG. 3B are views for explaining an example of the operation of the presenter unit 40. FIG. 3A is a side view and FIG. 3B is a top view. In this embodiment, although an counter-clockwise direction is exemplified as the first direction and a clockwise direction is exemplified as the second direction, the directions may be opposite.

The cut recording paper 10 is first transferred in the ejecting direction E by the presenter function unit 40*a* of the presenter unit 40. Specifically, as shown in FIG. 3A, the drive roller 41 is rotated in the counter-clockwise direction as shown by an arrow A1.

With this operation, the pinch roller 42 connected to the drive roller 41 via the connection arm 61 moves along the outer periphery of the drive roller 41 in the counter-clockwise direction to the first rotating position at which the movement of the pinch roller 42 is stopped by the fourth roller 44. At the first rotating position, the pinch roller 42 is pushed toward the drive roller 41 with the predetermined force while interposing the first transfer belt 51 therebetween. Thus, the pinch roller 42 is rotated in the clockwise direction in accordance with the rotation of the drive roller 41 as shown by an arrow B2.

The predetermined force applied by the pinch roller 42 to the first transfer belt 51 is determined by the torque limiter 62. By providing the torque limiter 62, the pinch roller 42 is moved along the outer periphery of the drive roller 41 to the first rotating position and then is rotated at the first rotating position while pushing the first transfer belt 51 with the predetermined force. Thus, as the first transfer belt 51 is pushed by the pinch roller 42 and the drive roller 41 with the predetermined force, lowering of a transferring power caused by the looseness of the first transfer belt 51 can be prevented.

In the presenter function unit 40*a*, as the drive roller 41 is rotated in the counter-clockwise direction as shown by the arrow A1, the first transfer belt 51 is moved in a direction as shown by an arrow C1. Therefore, the fourth roller 44 and the fifth roller 45 are also rotated in the counter-clockwise direction as shown by arrows A4 and A5, respectively, via the first transfer belt 51.

In the retractor function unit 40*b*, as the drive roller 41 is rotated in the counter-clockwise direction as shown by the arrow A1, the second transfer belt 52 is also moved in a direction as shown by an arrow C2. Therefore, the third roller 43 and the sixth roller 46 are also rotated in the counter-clockwise direction as shown by arrows A3 and A6, respectively, via the second transfer belt 52.

With this operation, the printed recording paper 10 is transferred in the ejecting direction E in the presenter function unit 40*a* by the first transfer belt 51 and the pinch roller 42. Subsequently, the printed recording paper 10 is further transferred to a position from which a user can pull out the printed recording paper 10 when the rotation of the drive roller 41 is terminated. At this state, a part of the printed recording paper 10 is still inserted between the first transfer belt 51 and the pinch roller 42.

The printing operation of the printer apparatus 1 of the embodiment is terminated when the printed recording paper 10 is pulled by the user at this state. However, if the printed recording paper 10 is not pulled out by the user after a predetermined period, an operation of recovering the printed recording paper 10 is performed after the predetermined period.

Figure 4A:
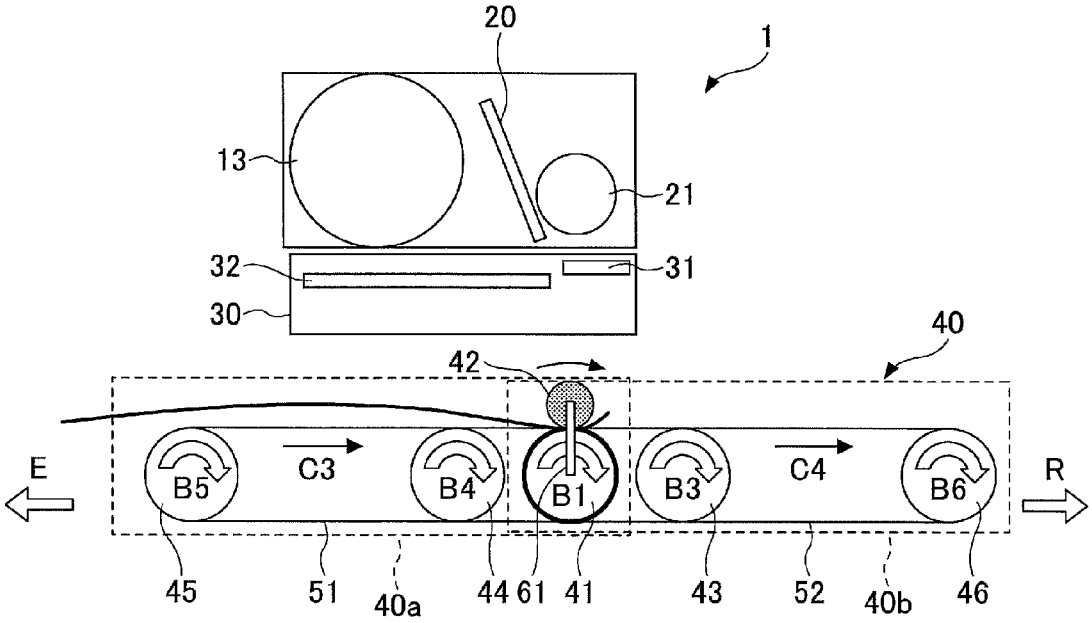
FIG. 4A and FIG. 4B are views for explaining the example of the operation of the presenter unit of the first embodiment.
Figure 4B:
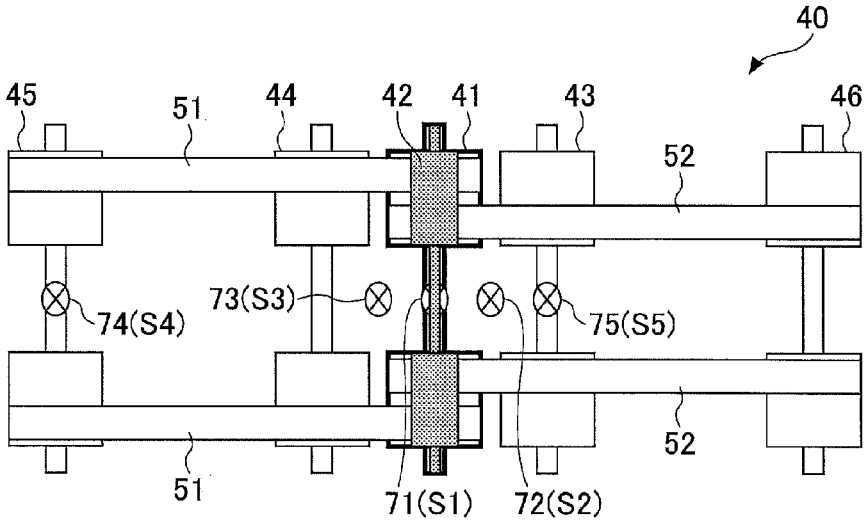

Specifically, in this case, as shown in FIG. 4A and FIG. 4B, the drive roller 41 is rotated in the clockwise direction as shown by an arrow B1. With this operation, the pinch roller 42 which is connected to the drive roller 41 via the connection arm 61 moves along the outer periphery of the drive roller 41 in the clockwise direction. FIG. 4A is a side view showing this state, and FIG. 4B is a top view showing this state.

At this time, in the presenter function unit 40*a*, as the drive roller 41 is rotated in the clockwise direction as shown by the arrow B1, the first transfer belt 51 is moved in a direction shown by an arrow C3. Therefore, the fourth roller 44 and the fifth roller 45 are also rotated in the clockwise direction as shown by arrows B4 and B5, respectively, via the first transfer belt 51.

Further, in the retractor function unit 40*b*, as the drive roller 41 is rotated in the clockwise direction as shown by the arrow B1, the second transfer belt 52 is moved in a direction as shown by an arrow C4. Therefore, the third roller 43 and the sixth roller 46 are rotated in the clockwise direction as shown by arrows B3 and B6, respectively, via the second transfer belt 52.

In this state, the printed recording paper 10 is moved with the pinch roller 42 while being interposed between the pinch roller 42 and the first transfer belt 51, or between the pinch roller 42 and the second transfer belt 52.

Subsequently, when the drive roller 41 is further rotated in the clockwise direction as shown by the arrow B1, the printed recording paper 10 is transferred in a recovering direction R in the retractor function unit 40*b*.

FIG. 5A and FIG. 5B are views for explaining an example of the operation of the presenter unit 40. FIG. 5A is a side view showing this state, and FIG. 5B is a top view showing this state. As described above, FIG. 5A and FIG. 5B show a state when the movement of the pinch roller 42 along the outer periphery of the drive roller 41 is stopped at the second rotating position.

With this operation, the pinch roller 42 connected to the drive roller 41 via the connection arm 61 moves along the outer periphery of the drive roller 41 to the second rotating position at which the movement of the pinch roller 42 is stopped by the third roller 43. At the second rotating position, the pinch roller 42 is pushed toward the drive roller 41 with the predetermined force while interposing the second transfer belt 52 therebetween. Thus, the pinch roller is rotated in the counter-clockwise direction in accordance with the rotation of the drive roller 41 as shown by an arrow A2.

The predetermined force applied by the pinch roller 42 to the second transfer belt 52 is determined by the torque limiter 62. By providing the torque limiter 62, the pinch roller 42 is moved along the outer periphery of the drive roller 41 to the second rotating position and then is rotated at the second rotating position while pushing the second transfer belt 52 with the predetermined force. Thus, as the second transfer belt 52 is pushed by the pinch roller 42 and the drive roller 41 with the predetermined force, lowering of a transferring power caused by the looseness of the second transfer belt 52 can be prevented.

In the presenter function unit 40*a*, as the drive roller 41 is rotated in the clockwise direction as shown by the arrow B1, the first transfer belt 51 is moved in the direction shown by the arrow C3. Therefore, the fourth roller 44 and the fifth roller 45 are also rotated in the clockwise direction as shown by the arrows B4 and B, respectively, via the first transfer belt 51.

In the retractor function unit 40*b*, as the drive roller 41 is rotated in the clockwise direction as shown by the arrow B1, the second transfer belt 52 is moved in the direction shown by the arrow C4. Therefore, the third roller 43 and the sixth roller 46 are rotated in the clockwise direction as shown by the arrows B3 and B6, respectively, via the second transfer belt 52.

With this operation, the printed recording paper 10 is transferred in the recovering direction R in the retractor function unit 40*b* by the second transfer belt 52 and the pinch roller 42 to be recovered.

(Method of Controlling Printer Apparatus)

A transferring method of the printed recording paper 10 in the printer apparatus 1 of the embodiment is explained with reference to FIG. 6 to FIG. 10. This transferring method is controlled by the control substrate 12.

First, in step S102, whether the presenter unit 40 is attached to the printer apparatus 1 is determined. When the presenter unit 40 is determined to be attached to the printer apparatus 1 (YES in step S102), the process moves to step S104. On the other hand, when the presenter unit 40 is determined not to be attached, the printed recording paper 10 is ejected and the process is finished as the presenter operation cannot be performed.

In step S104, an operation of receiving the recording paper 10 is performed. This operation is explained in detail with reference to FIG. 7 later.

In step S106, whether the operation of receiving the recording paper 10 is normally completed is determined. When it is determined that the operation of receiving the recording paper 10 is normally completed (YES in step S106), the process moves to step S108. On the other hand, when it is determined that the operation of receiving the recording paper 10 is not normally performed (NO in step S106), the process is finished after an error message or the like is displayed.

In step S108, an operation of pre-ejection of the recording paper 10 is performed. This operation is explained in detail with reference to FIG. 8 later.

In step S110, whether the operation of pre-ejection of the recording paper 10 is normally completed is determined. When it is determined that the operation of pre-ejection of the recording paper 10 is normally completed (YES in step S110), the process moves to step S112. On the other hand, when it is determined that the operation of pre-ejection of the recording paper 10 is not normally completed (NO in step S110), an error or the like is displayed and the process is finished.

In step S112, whether a flag to eject the recording paper 10 is on is determined. Specifically, when the flag to eject the recording paper 10 is previously set to be on at setting of the printer apparatus 1 (YES in step S112), the process moves to step S114. On the other hand, when the flag to eject the recording paper 10 is not on (NO in step S112), the process moves to step S118.

In step S114, an ejection operation of ejection of the recording paper 10 is performed. This operation is explained in detail with reference to FIG. 9 later.

In step S116, whether the ejection of the recording paper 10 is normally completed is determined. When it is determined that the ejection of the recording paper 10 is normally completed (YES in step S116), the printing operation of the printer apparatus 1 of the embodiment is finished. On the other hand, when it is determined that the ejection of the recording paper 10 is not normally completed (NO in step S116), an error or the like is displayed and the process is finished.

In step S118, whether a flag to recover the recording paper 10 is on is determined. Specifically, when the flag to recover the recording paper 10 is previously set to be on at setting of the printer apparatus 1 (YES in step S118), the process moves to step S120. On the other hand, when the flag to recover the recording paper 10 is not on (NO in step S118), an error or the like is displayed and the process is finished.

In step S120, a recovering operation of recovering the recording paper 10 is performed. This operation is explained in detail with reference to FIG. 10 later.

In step S122, whether the recovering operation of the recording paper 10 is normally completed is determined. When it is determined that the recovering operation of the recording paper 10 is normally completed (YES in step S122), the printing operation of the printer apparatus 1 of the embodiment is finished. On the other hand, when it is determined that the recovering operation of the recording paper 10 is not normally completed (NO in step S122), an error or the like is displayed and the process is finished.

The operation of receiving the recording paper 10 of step S104 is explained in detail with reference to FIG. 7.

First, in step S202, the first sensor 71 (S1) determines whether an existence of the recording paper 10 is detected. When it is determined that the existence of the recording paper 10 is detected by the first sensor 71 (S1) (YES in step S202), the process moves to step S206. On the other hand, when it is determined that the existence of the recording paper 10 is not detected by the first sensor 71 (S1) (NO in step S202), the process moves to step S204.

In step S204, it is determined whether a predetermined period has passed. After the predetermined periods has passed (YES in S204), it is determined that a recording paper jam occurs at an exit of the cutter unit 30. At this time, it is determined that the operation of receiving the recording paper 10 is not normally completed in step S106 shown in FIG. 6. On the other hand, if before the predetermined period has passed (NO in step S204), the process moves back to step S202.

In step S206, the third sensor 73 (S3) determines whether an existence of the recording paper 10 is detected. When it is determined that the existence of the recording paper 10 is detected by the third sensor 73 (S3), the operation of receiving the recording paper 10 is normally completed. At this time, it is determined that the operation of receiving the recording paper 10 is normally completed in step S106 shown in FIG. 6. On the other hand, when it is determined that the existence of the recording paper 10 is not detected by the third sensor 73 (S3), the process moves to step S208.

In step S208, it is determined whether a predetermined period has passed. After the predetermined period has passed in step S208 (YES in step S208), it is determined that a recording paper jam occurs at an entrance of the presenter unit 40. At this time, it is determined that the operation of receiving the recording paper 10 is not normally completed in step S106 shown in FIG. 6. On the other hand, when it is determined that the predetermined period has not passed (NO in step S208), the process moves back to step S206.

Figure 6:
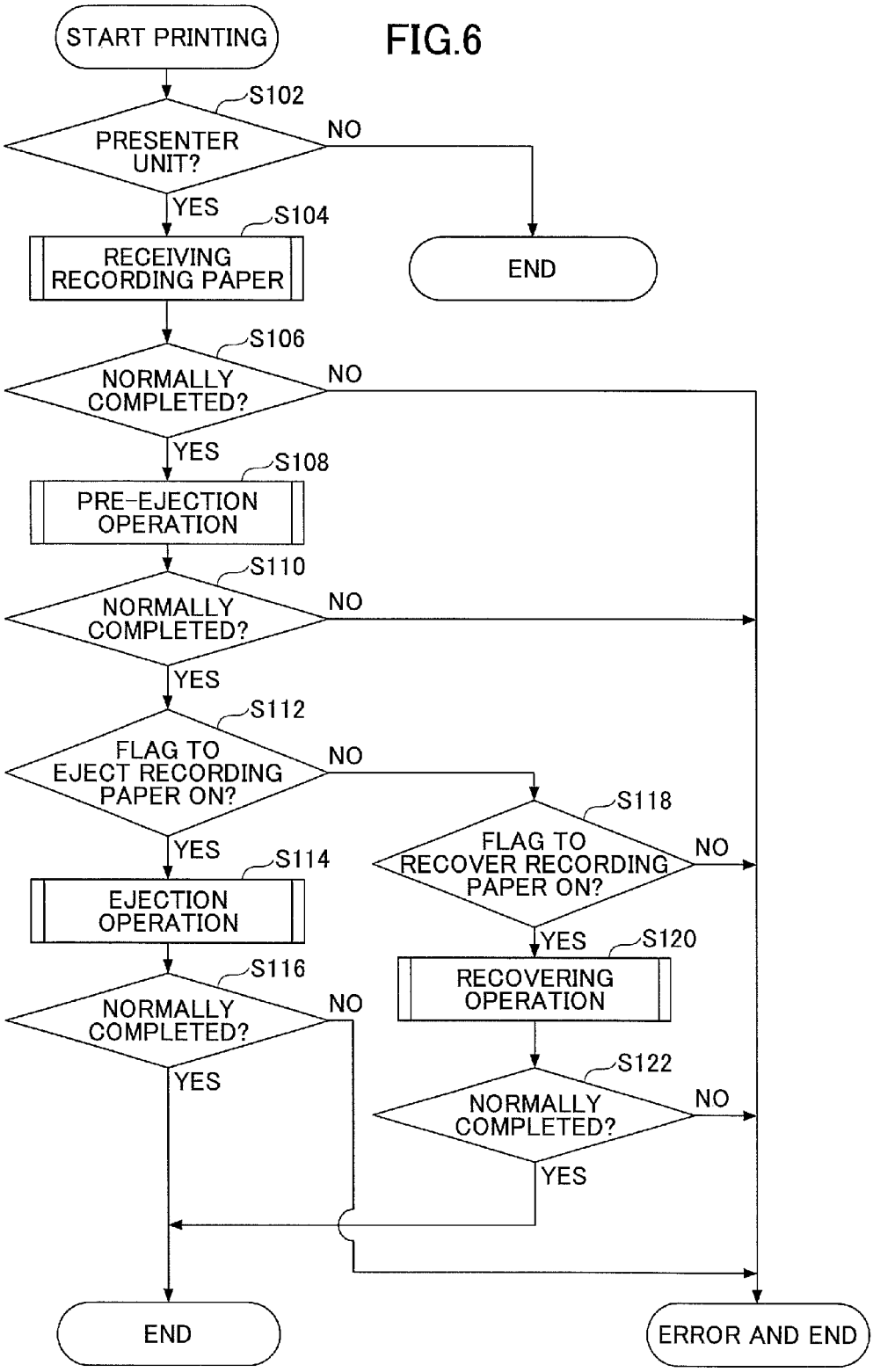
FIG. 6 is a flowchart showing an example of a method of controlling the printer apparatus of the first embodiment.
Figure 7:
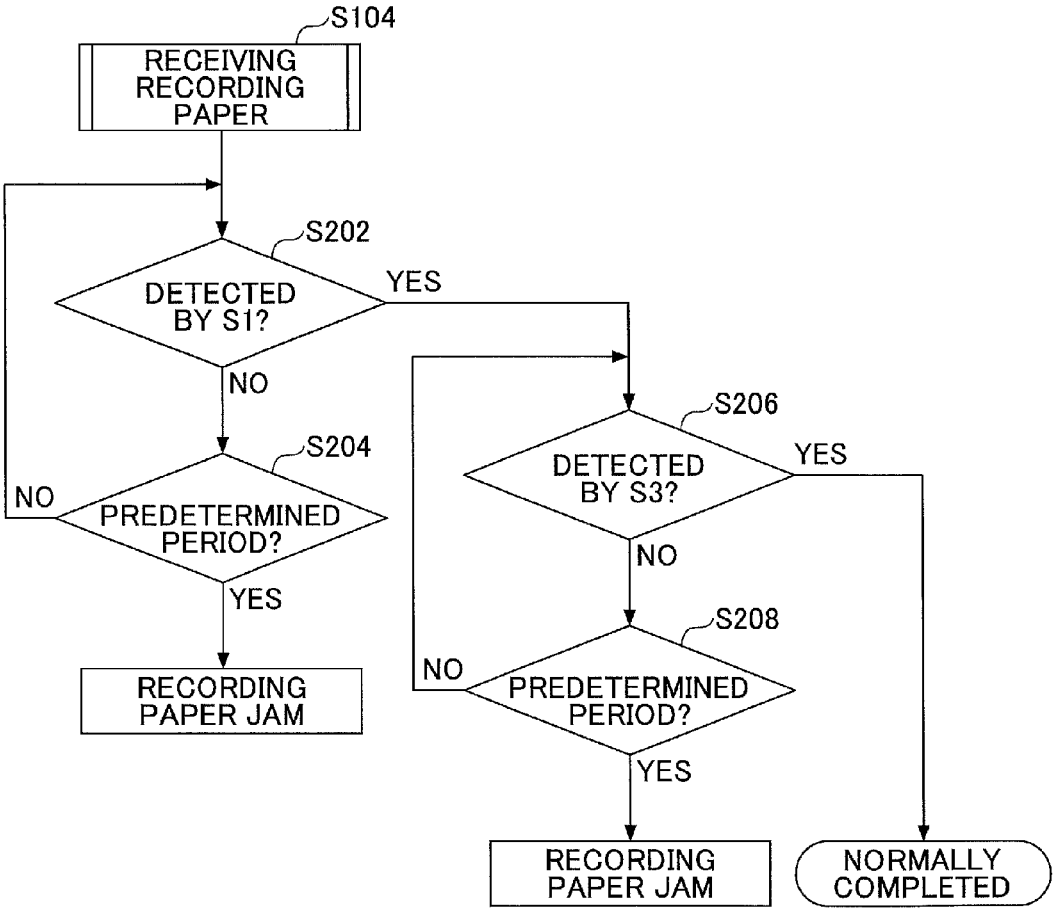
FIG. 7 is a flowchart showing an example of a method of controlling the printer apparatus of the first embodiment.

As described above, the operation of receiving the recording paper 10 of step S104 shown in FIG. 7 is finished and the process moves to step S106 shown in FIG. 6.

Figure 8:
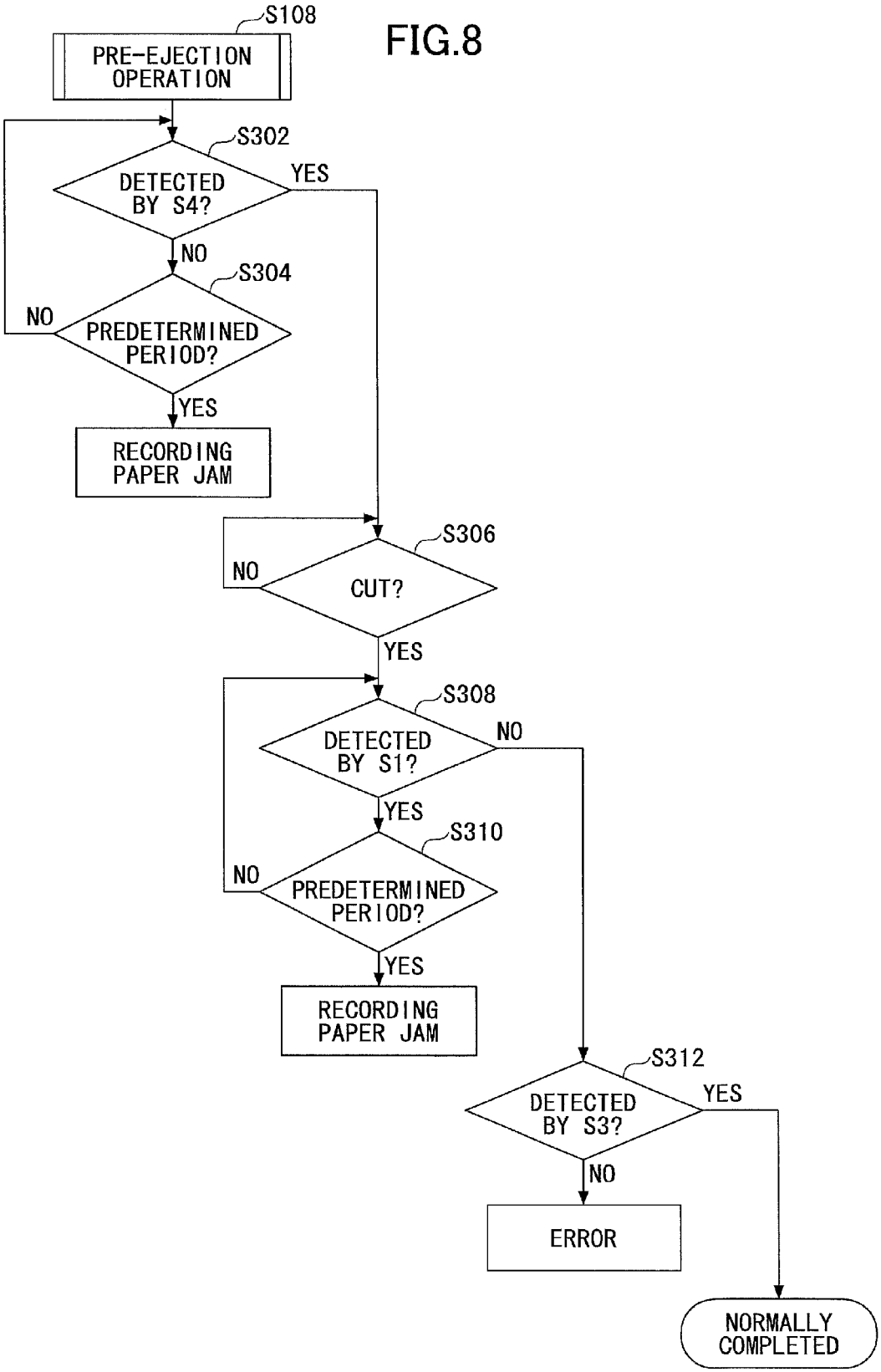
FIG. 8 is a flowchart showing an example of a method of controlling the printer apparatus of the first embodiment.

The operation of pre-ejection of the recording paper 10 of step S108 is explained in detail with reference to FIG. 8.

First, in step S302, the fourth sensor 74 (S4) determines whether an existence of the recording paper 10 is detected. When it is determined that the existence of the recording paper 10 is detected by the fourth sensor 74 (S4) (YES in step S302), the process moves to step S306. On the other hand, when it is determined that the existence of the recording paper 10 is not detected by the fourth sensor 74 (S4) (NO in step S302), the process moves to step S304.

In step S304, it is determined whether a predetermined period has passed. After the predetermined period has passed (YES in step S304), it is determined that a recording paper jam occurs at a transferring path in the presenter unit 40. At this time, it is determined that the operation of pre-ejection of the recording paper 10 is not normally completed in step S110 shown in FIG. 6. On the other hand, if before the predetermined period has passed (NO in step S304), the process moves back to step S302.

In step S306, whether the printed recording paper 10 is cut with the predetermined lengths in the cutter unit 30 is determined after the printed recording paper 10 is cut at the cutter unit 30. When it is determined that the printed recording paper 10 is cut with the desired length in the cutter unit 30 (YES in step S306), the process moves to step S308. On the other hand, when it is determined that the printed recording paper 10 is not cut with the desired length in the cutter unit 30 (YES in step S306), this process in step S306 is performed again.

Further in step S308, the first sensor 71 (S1) determines whether an existence of the recording paper 10 is detected. When it is determined that the existence of the recording paper 10 is detected by the first sensor 71 (S1) (YES in step S308), the process moves to step S310. On the other hand, when it is determined that the existence of the recording paper 10 is not detected by the first sensor 71 (S1) (NO in step S308), the process moves to step S312.

In step S310, it is determined whether a predetermined period has passed. After the predetermined period has passed (YES in step S310), it is determined that a recording paper jam occurs at an entrance of the presenter unit 40. At this time, it is determined that the operation of pre-ejection of the recording paper 10 is not normally completed in step S110 shown in FIG. 6. On the other hand, if before the predetermined period has passed (NO in step S310), the process moves back to step S308.

In step S312, the third sensor 73 (S3) determines whether an existence of the recording paper 10 is detected. When it is determined that the existence of the recording paper 10 is detected by the third sensor 73 (S3) (YES in step S312), the operation of pre-ejection of the recording paper 10 is normally completed. At this time, it is determined that the operation of pre-ejection of the recording paper 10 is normally completed in step S110 shown in FIG. 6. On the other hand, when it is determined that the existence of the recording paper 10 is not detected by the third sensor 73 (S3) (NO in step S312), it is determined that an error occurs in the transferring path of the recording paper 10. At this time, it is determined that the operation of pre-ejection of the recording paper 10 is not normally completed in step S110 shown in FIG. 6.

With the above operation, the operation of the pre-ejection of the recording paper 10 of step S108 in FIG. 6 is finished and the process moves to step S110.

Figure 9:
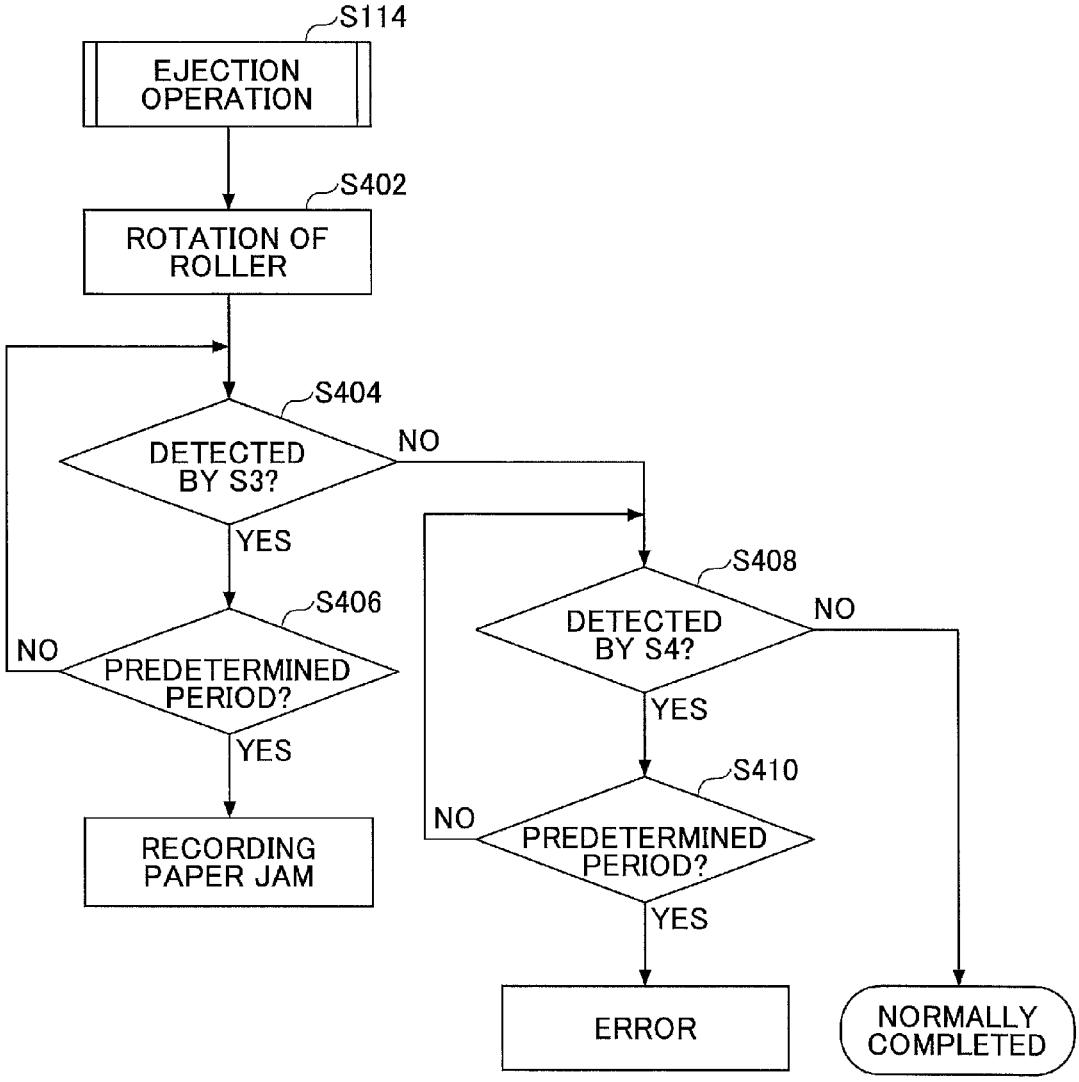
FIG. 9 is a flowchart showing an example of a method of controlling the printer apparatus of the first embodiment.

Next, the ejection operation of the ejection of the recording paper 10 of step S114 is explained in detail with reference to FIG. 9.

First, in step S402, the drive roller 41 is rotated in the counter-clockwise direction shown by the arrow A1 in FIG. 3A, the printed recording paper 10 is transferred in the ejecting direction E by the presenter function unit 40*a* of the presenter unit 40.

In step S404, the third sensor 73 (S3) determines whether an existence of the recording paper 10 is detected. When it is determined that the existence of the recording paper 10 is detected by the third sensor 73 (S3) (YES in step S404), the process moves to step S406. On the other hand, when it is determined that the existence of the recording paper 10 is not detected by the third sensor 73 (S3) (NO in step S404), the process moves to step S408.

In step S406, it is determined whether a predetermined period has passed. After the predetermined period has passed (YES in step S406), it is determined that a recording paper jam occurs in an ejecting path in the presenter unit 40. At this time, it is determined that the ejection of the recording paper 10 is not normally completed in step S116 shown in FIG. 6. On the other hand, if before the predetermined period has passed (NO in step S406), the process moves back to step S404.

In step S408, the fourth sensor 74 (S4) determines whether an existence of the recording paper 10 is detected. When it is determined that the existence of the recording paper 10 by the fourth sensor 74 (S4) is detected (YES in step S408), the process moves to step S410. On the other hand, when it is determined that the existence of the recording paper 10 is not detected by the fourth sensor 74 (S4) (NO in step S408), the ejection of the recording paper 10 is normally completed. At this time, it is determined that the operation of pre-ejection of the recording paper 10 of step S116 shown in FIG. 6 is normally completed.

In step S410, it is determined whether a predetermined period has passed. After the predetermined period has passed (YES in step S410), it is determined an ejecting error occurs in the presenter unit 40. At this time, it is determined that the ejection of the recording paper 10 of step S116 shown in FIG. 6 is not normally completed. On the other hand, if before the predetermined period has passed (NO in step S410), the process moves back to step S408.

With the above operation, the ejection operation of the ejection of the recording paper 10 of step S114 in FIG. 6 is finished and the process moves to step S116.

Figure 10:
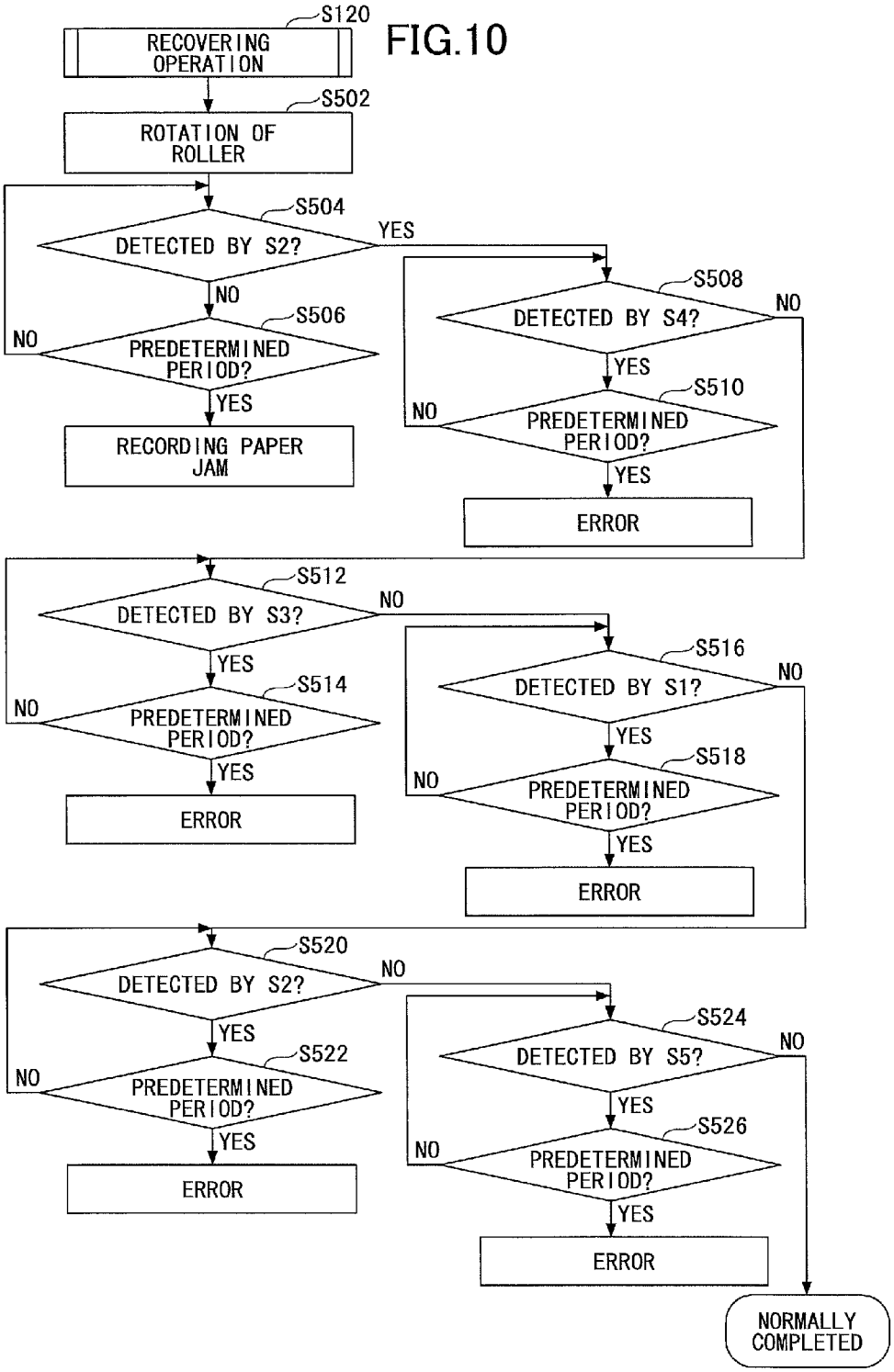
FIG. 10 is a flowchart showing an example of a method of controlling the printer apparatus of the first embodiment.

Next, the recovering operation of the recording paper 10 of step S120 is explained in detail with reference to FIG. 10.

First, in step S502, the drive roller 41 is rotated in the clockwise direction shown by the arrow B1 in FIG. 4A, the printed recording paper 10 is transferred in the recovering direction R by the retractor function unit 40*b* of the presenter unit 40.

In step S504, whether an existence of the recording paper 10 is detected by the second sensor 72 (S2) is determined. When it is determined that the existence of the recording paper 10 is not detected by the second sensor 72 (S2) (NO in step S504), the process moves to step S506. On the other hand, when the existence of the recording paper 10 is detected by the second sensor 72 (S2) (YES in step S504), the process moves to step S508.

In step S506, it is determined whether a predetermined period has passed. After the predetermined period has passed (YES in step S506), it is determined that a recording paper jam occurs in the presenter unit 40. At this time, it is determined that the recovering operation of the recording paper 10 of step S122 shown in FIG. 6 is not normally completed. On the other hand, if before the predetermined period has passed (NO in step S506), the process moves back to step S504.

In step S508, the fourth sensor 74 (S4) determines whether an existence of the recording paper 10 is detected. When it is determined that the existence of the recording paper 10 is detected by the fourth sensor 74 (S4) (YES in step S508), the process moves to step S510. On the other hand, when it is determined that the existence of the recording paper 10 is not detected by the second sensor 72 (S2) (NO in step S508), the process moves to step S512.

In step S510, it is determined whether a predetermined period has passed. After the predetermined period has passed (YES in step S510), it is determined that a recovering error occurs in the presenter unit 40. At this time, it is determined that the recovering operation of the recording paper 10 of step S122 shown in FIG. 6 is not normally completed. On the other hand, if before the predetermined period has passed (NO in step S510), the process moves back to step S508.

In step S512, the third sensor 73 (S3) determines whether an existence of the recording paper 10 is detected. When it is determined that the existence of the recording paper 10 is detected by the third sensor 73 (S3) (YES in step S512), the process moves to step S514. On the other hand, when it is determined that the existence of the recording paper 10 is not detected by the third sensor 73 (S3) (NO in step S512), the process moves to step S516.

In step S514, it is determined whether a predetermined period has passed. After the predetermined period has passed (YES in step S514), it is determined that the recovering error occurs in the presenter unit 40. At this time, it is determined that the recovering operation of the recording paper 10 of step S122 shown in FIG. 6 is not normally completed. On the other hand, if before the predetermined period has passed (NO in step S514), the process moves back to step S512.

In step S516, the first sensor 71 (S1) determines whether an existence of the recording paper 10 is detected. When it is determined that the existence of the recording paper 10 is detected by the first sensor 71 (S1) (YES in step S516), the process moves to step S518. On the other hand, when it is determined that the existence of the recording paper 10 is not detected by the first sensor 71 (S1) (NO in step S516), the process moves to step S520.

In step S518, it is determined whether a predetermined period has passed. After the predetermined period has passed (YES in step S518), it is determined that a recovering error occurs in the presenter unit 40. At this time, it is determined that the recovering operation of the recording paper 10 of step S122 shown in FIG. 6 is not normally completed. On the other hand, if before the predetermined period has passed (NO in step S518), the process moves back to step S516.

In step S520, whether an existence of the recording paper 10 is detected by the second sensor 72 (S2) is determined. When it is determined that the existence of the recording paper 10 is detected by the second sensor 72 (S2) (YES in step S520), the process moves to step S522. On the other hand, when it is determined that the existence of the recording paper 10 is not detected by the second sensor 72 (S2) (NO in step S520), the process moves to step S524.

In step S522, it is determined whether a predetermined period has passed. After the predetermined period has passed (YES in step S522), it is determined that a recovering error occurs in the presenter unit 40. At this time, it is determined that the recovering operation of the recording paper 10 of step S122 shown in FIG. 6 is not normally completed. On the other hand, if before the predetermined period has passed (NO in step S522), the process moves back to step S520.

In step S524, the fifth sensor 75 (S5) determines whether an existence of the recording paper 10 is detected. When it is determined that the existence of the recording paper 10 is detected by the fifth sensor 75 (S5) (YES in step S524), the process moves to step S526. On the other hand, when it is determined that the existence of the recording paper 10 is not detected by the fifth sensor 75 (S5) (NO in step S524), the recovering operation of the recording paper 10 is normally completed. At this time, it is determined that the operation of pre-ejection of the recording paper 10 of step S122 shown in FIG. 6 is normally completed.

In step S526, it is determined whether a predetermined period has passed. After the predetermined period has passed (YES in step S526), it is determined that a recovering error occurs in the presenter unit 40. At this time, it is determined that the ejection of the recording paper 10 of step S122 shown in FIG. 6 is not normally completed. On the other hand, if before the predetermined period has passed (NO in step S526), the process moves back to step S524.

With the above operation, the recovering operation of the recording paper 10 of step S120 shown in FIG. 6 is finished, and the process moves to step S122.

Second Embodiment

The second embodiment is explained. In this embodiment, the structure of the presenter unit is different from that of the first embodiment. In this embodiment, the size of the presenter unit is made smaller.

Figure 11A:
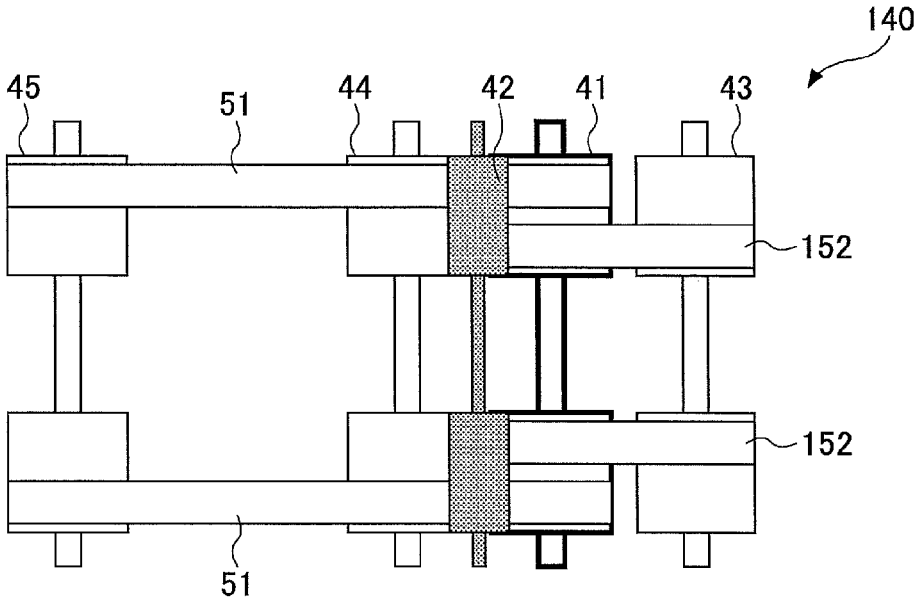
FIG. 11A and FIG. 11B are views for explaining an example of the operation of the presenter unit of a second embodiment.
Figure 11B:
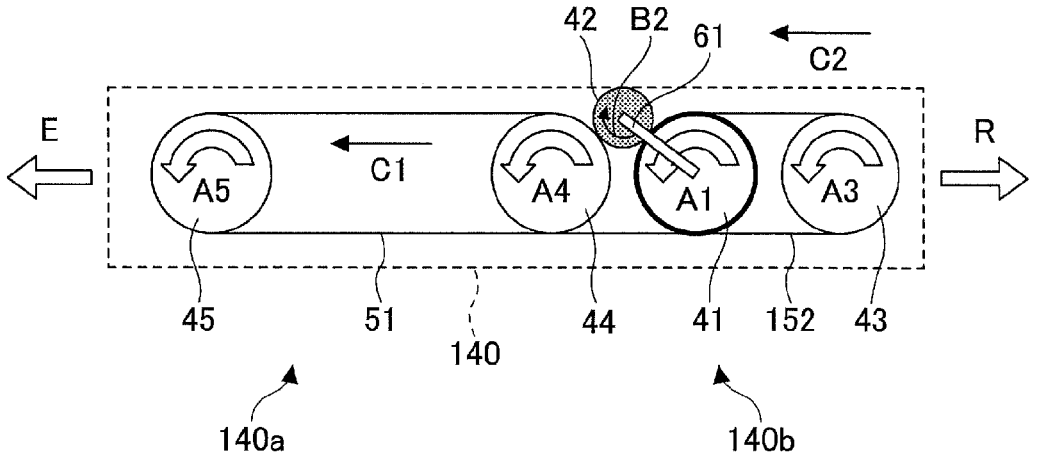
Figure 12A:
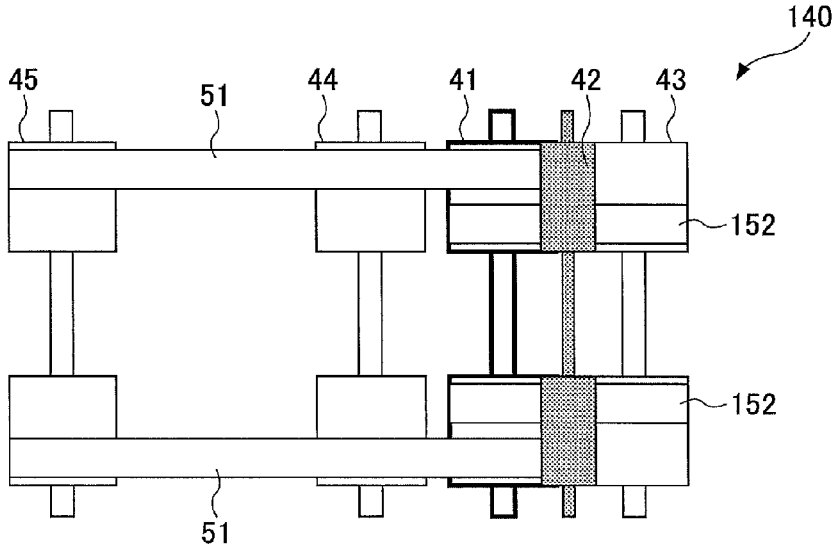
FIG. 12A and FIG. 12B are views for explaining the example of the operation of the presenter unit of the second embodiment.
Figure 12B:
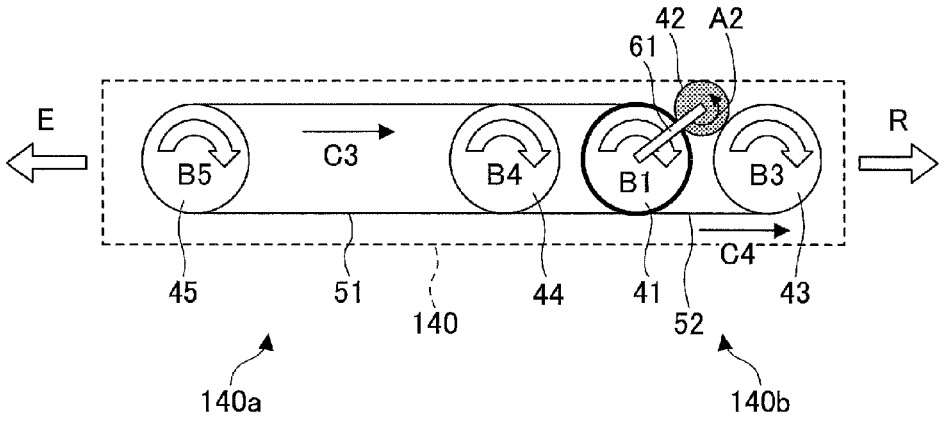

The printer apparatus of the second embodiment is explained with reference to FIG. 11A, FIG. 11B, FIG. 12A and FIG. 12B. FIG. 11A and FIG. 12A are top views and FIG. 11B and FIG. 12B are side views. In FIG. 11A, FIG. 11B, FIG. 12A and FIG. 12B, the recording paper 10 is not shown.

The printer apparatus of this embodiment includes a presenter unit 140 instead of the presenter unit 40 of the first embodiment. The presenter unit 140 of the embodiment does not include the sixth roller 46. With this structure, a retractor function unit 140*b* can be made shorter. Specifically, the presenter unit 140 includes the drive roller 41, the pinch roller 42, the third roller 43, the fourth roller 44, the fifth roller 45, the first transfer belt 51, a second transfer belt 152 and the connection arm 61. Further, although not shown in the drawings, the presenter unit 140 may include the first pinch roller 47. The first transfer belt 51 is hung around the drive roller 41, the fourth roller 44, and the fifth roller 45. The second transfer belt 152 is hung around the drive roller 41 and the third roller 43.

When ejecting the printed recording paper 10, as shown in FIG. 11A and FIG. 11B, the drive roller 41 is rotated in the counter-clockwise direction as shown by the arrow A1. At this time, the pinch roller 42 is rotated in the clockwise direction as shown by the arrow B2 in accordance with the rotation of the drive roller 41 at the first rotating position. Thus, the printed recording paper 10 is transferred by the pinch roller 42 and the first transfer belt 51 in the ejecting direction E.

When recovering the printed recording paper 10, as shown in FIG. 12A and FIG. 12B, the drive roller 41 is rotated in the clockwise direction as shown by the arrow B1. At this time, the pinch roller 42 is moved to the second rotating position and is rotated in the counter-clockwise direction as shown by the arrow A2 in accordance with the rotation of the drive roller 41 at the second rotating position. Thus, the printed recording paper 10 is transferred by the pinch roller 42 and the second transfer belt 152 in the recovering direction R.

Alternative Example 1

Figure 13A:
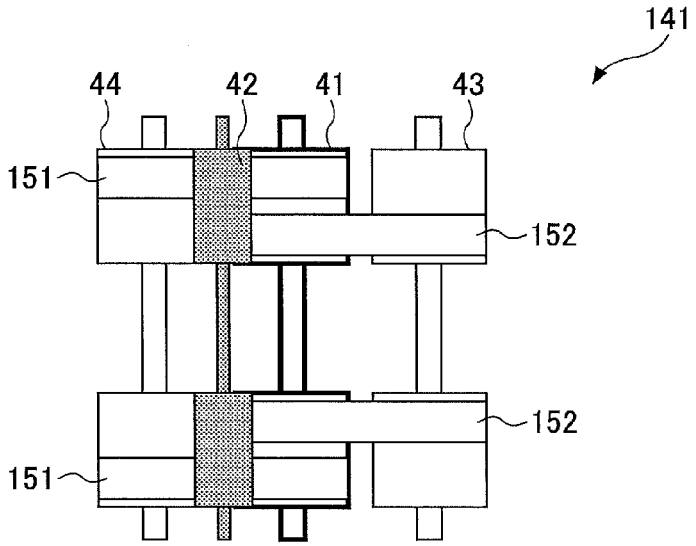
FIG. 13A and FIG. 13B are views for explaining another example of the operation of the presenter unit of the second embodiment.
Figure 13B:
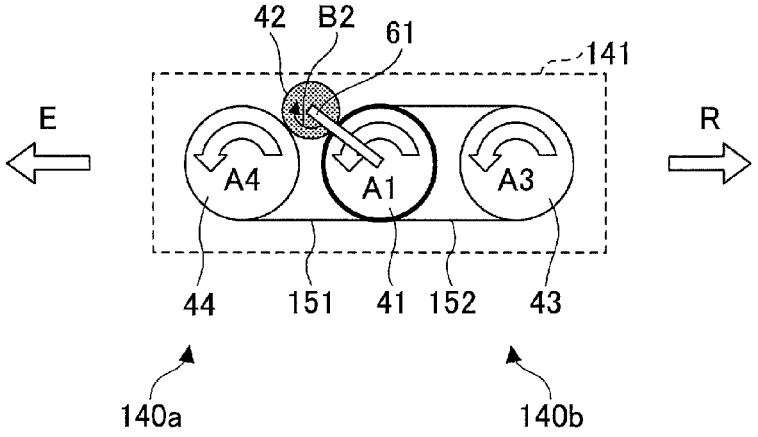
Figure 14A:
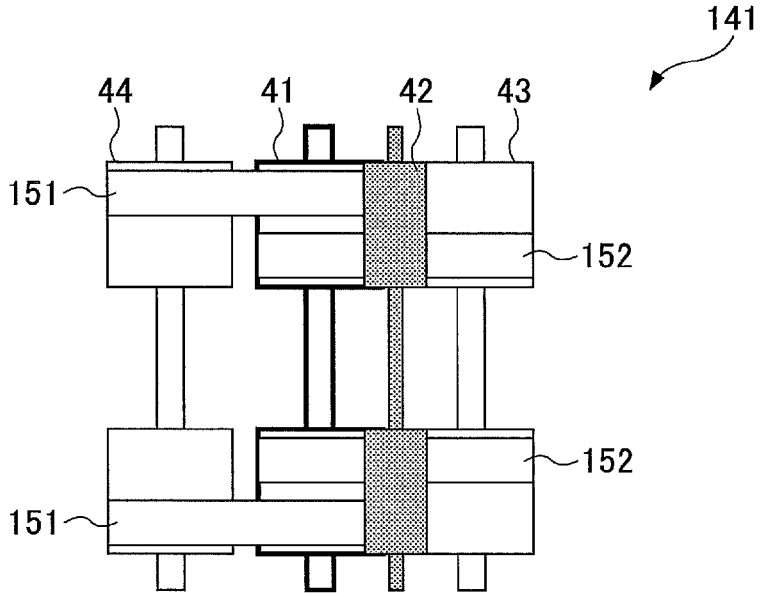
FIG. 14A and FIG. 14B are views for explaining the other example of the operation of the presenter unit of the second embodiment.
Figure 14B:
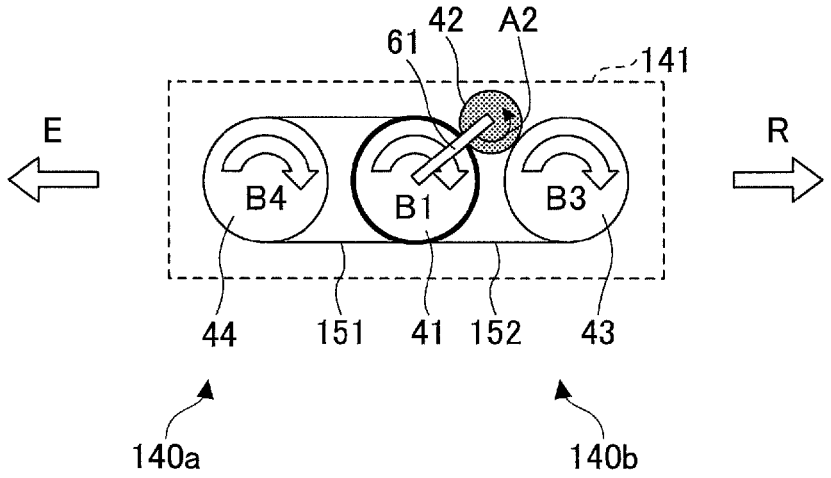

An alternative example 1 of the embodiment is explained with reference to FIG. 13A, FIG. 13B, FIG. 14A and FIG. 14B. FIG. 13A and FIG. 14A are top views and FIG. 13B and FIG. 14B are side views. In FIG. 13A, FIG. 13B, FIG. 14A and FIG. 14B, the recording paper 10 is not shown.

The printer apparatus of the example includes a presenter unit 141 instead of the presenter unit 40 of the first embodiment or the presenter unit 140 shown in FIG. 11A, FIG. 11B, FIG. 12A and FIG. 12B. The presenter unit 141 of the example does not include the fifth roller 45. With this structure, a presenter function unit 140*a* can be made shorter. Specifically, the presenter unit 141 includes the drive roller 41, the pinch roller 42, the third roller 43, the fourth roller 44, a first transfer belt 151, the second transfer belt 152, and the connection arm 61. The first transfer belt 151 is hung around the drive roller 41 and the fourth roller 44. The second transfer belt 152 is hung around the drive roller 41 and the third roller 43.

When ejecting the printed recording paper 10, as shown in FIG. 13A and FIG. 13B, the drive roller 41 is rotated in the counter-clockwise direction as shown by the arrow A1. At this time, the pinch roller 42 is rotated in the clockwise direction as shown by the arrow B2 in accordance with the rotation of the drive roller 41 at the first rotating position. Thus, the printed recording paper 10 is transferred by the pinch roller 42 and the first transfer belt 151 in the ejecting direction E.

When recovering the printed recording paper 10, as shown in FIG. 14A and FIG. 14B, the drive roller 41 is rotated in the clockwise direction as shown by the arrow B1. At this time, the pinch roller 42 is moved to the second rotating position and is rotated in the counter-clockwise direction as shown by the arrow A2 in accordance with the rotation of the drive roller 41 at the second rotating position. Thus, the printed recording paper 10 is transferred by the pinch roller 42 and the second transfer belt 152 in the recovering direction R.

Alternative Example 2

Figure 15A:
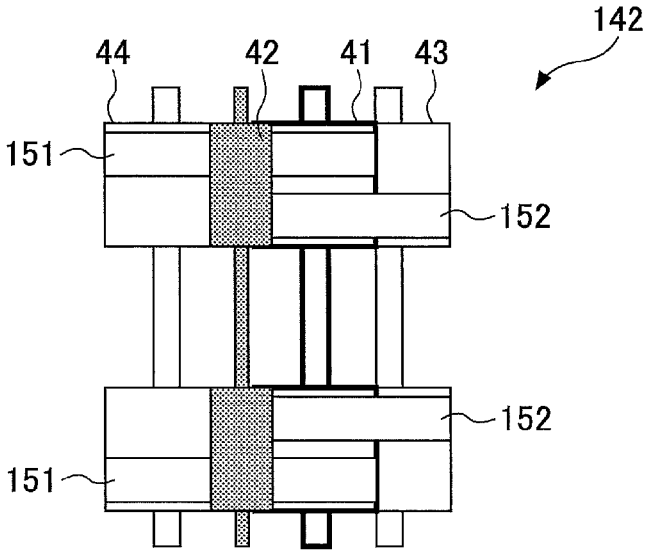
FIG. 15A and FIG. 15B are views for explaining another example of the operation of the presenter unit of the second embodiment.
Figure 15B:
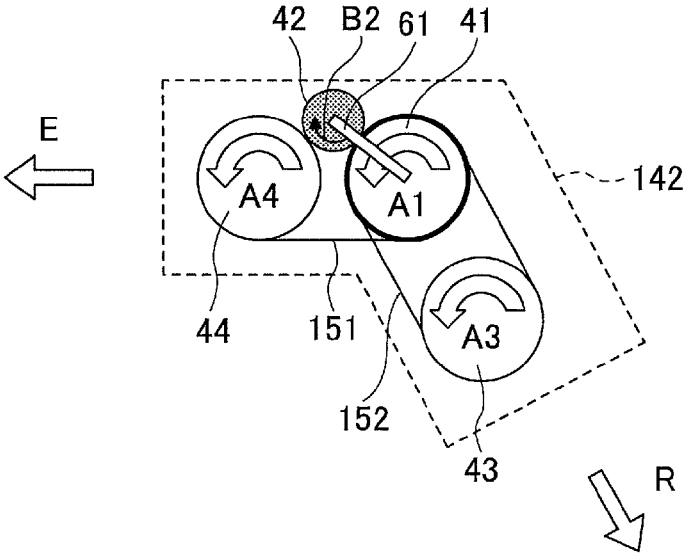
Figure 16A:
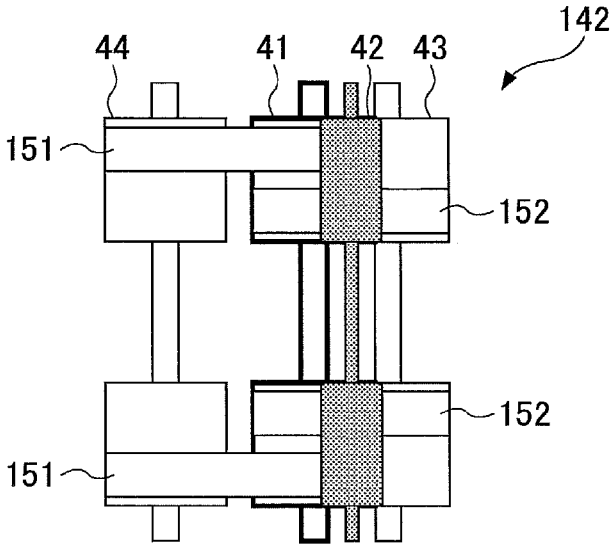
FIG. 16A and FIG. 16B are views for explaining the other example of the operation of the presenter unit of the second embodiment.
Figure 16B:
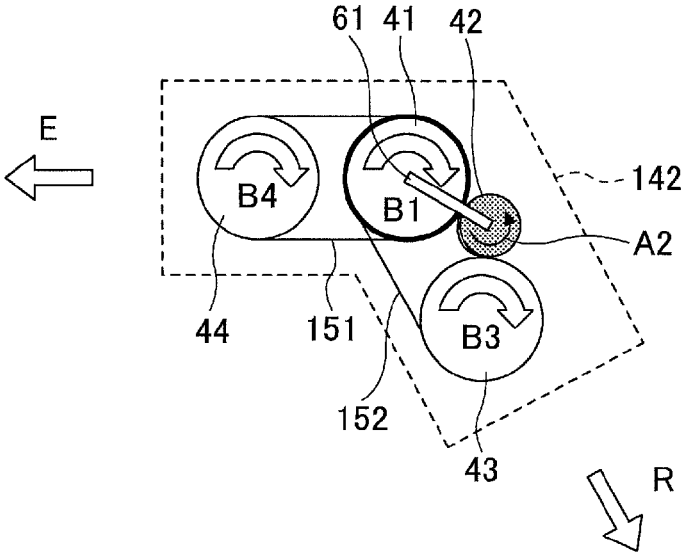

An alternative example 2 of the embodiment is explained with reference to FIG. 15A, FIG. 15B, FIG. 16A and FIG. 16B. FIG. 15A and FIG. 16A are top views and FIG. 15B and FIG. 16B are side views. In FIG. 135, FIG. 15B, FIG. 16A and FIG. 16, the recording paper 10 is not shown.

The printer apparatus of the example includes a presenter unit 142 instead of the presenter unit 40, the presenter unit 140, or the presenter unit 141. In the presenter unit 142, as shown in FIG. 15B, the third roller 43 and the fourth roller 44 are not positioned to be aligned on a straight line when seen from the side. In other words, the first transfer belt 151 and the second transfer belt 152 are not positioned to be aligned on a straight line when seen from the side. Thus, the ejecting direction E and the recovering direction R are configured to have an angle less than 180 degree. As shown in this example, the presenter unit may be configured such that the ejecting direction E and the recovering direction R are configured to have a desired angle.

When ejecting the printed recording paper 10, as shown in FIG. 15A and FIG. 15B, the drive roller 41 is rotated in the counter-clockwise direction as shown by the arrow A1. At this time, the pinch roller 42 is rotated in the clockwise direction as shown by the arrow B2 in accordance with the rotation of the drive roller 41 at the first rotating position. Thus, the printed recording paper 10 is transferred by the pinch roller 42 and the first transfer belt 151 in the ejecting direction E.

When recovering the printed recording paper 10, as shown in FIG. 16A and FIG. 16B, the drive roller 41 is rotated in the clockwise direction as shown by the arrow B1. At this time, the pinch roller 42 is moved to the second rotating position and is rotated in the counter-clockwise direction as shown by the arrow A2 in accordance with the rotation of the drive roller 41 at the second rotating position. Thus, the printed recording paper 10 is transferred by the pinch roller 42 and the second transfer belt 152 in the recovering direction R.

Alternative Example 3

An alternative example 3 of the embodiment is explained with reference to FIG. 17A and FIG. 17B. The printer apparatus of the example includes a presenter unit 143 instead of the presenter unit 40, the presenter unit 140, the presenter unit 141, or the presenter unit 142.

The presenter unit 143 does not include the fourth roller 44, the fifth roller 45, the sixth roller 46 and the first transfer belt 51. With this structure, the presenter unit 143 can be made shorter. Specifically, the presenter unit 143 includes the drive roller 41, the pinch roller 42, the third roller 43, the second transfer belt 152, the connection arm 61, and a stopper member 81. The second transfer belt 152 is hung around the drive roller 41 and the third roller 43.

The stopper member 81 is configured to stop the movement of the pinch roller 42 along the outer periphery of the drive roller 41 at the first rotating position. For example, the stopper member 81 may be configured to stop the rotation of the connection arm 61 at the first rotating position.

Figure 17A:
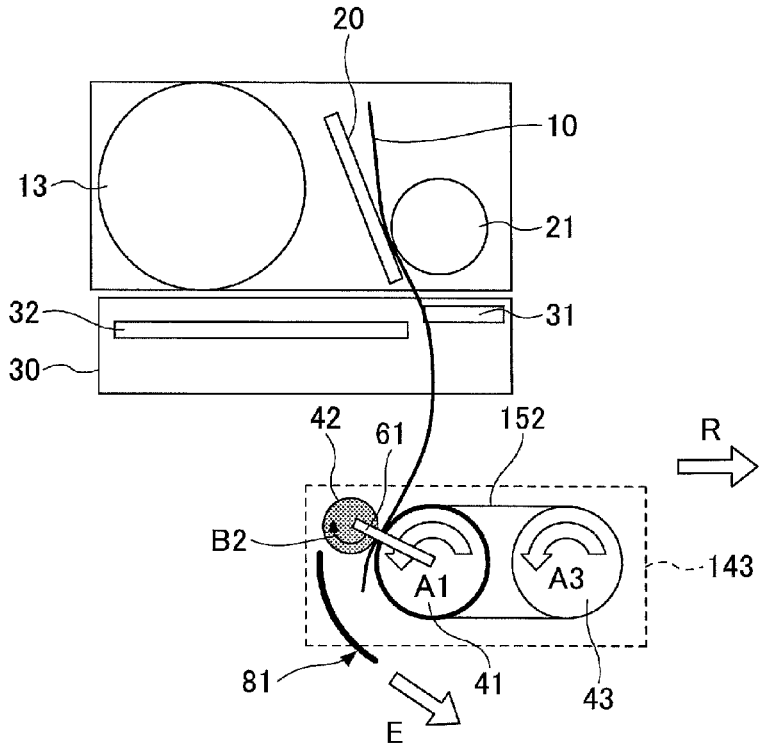
FIG. 17A and FIG. 17B are views for explaining another example of the operation of the presenter unit of the second embodiment.

When ejecting the printed recording paper 10, as shown in FIG. 17A, the drive roller 41 is rotated in the counter-clockwise direction as shown by the arrow A1. At this time, the pinch roller 42 is moved along the outer periphery of the drive roller 41 in the counter-clockwise direction. Then, the movement of the pinch roller 42 is stopped by the stopper member 81 at the first rotating position. Thereafter, the pinch roller 42 is rotated in the clockwise direction as shown by the arrow B2 in accordance with the rotation of the drive roller 41 at the first rotating position. Thus, the printed recording paper 10 is transferred by the pinch roller 42 and the second transfer belt 152 in the ejecting direction E.

Figure 17B:
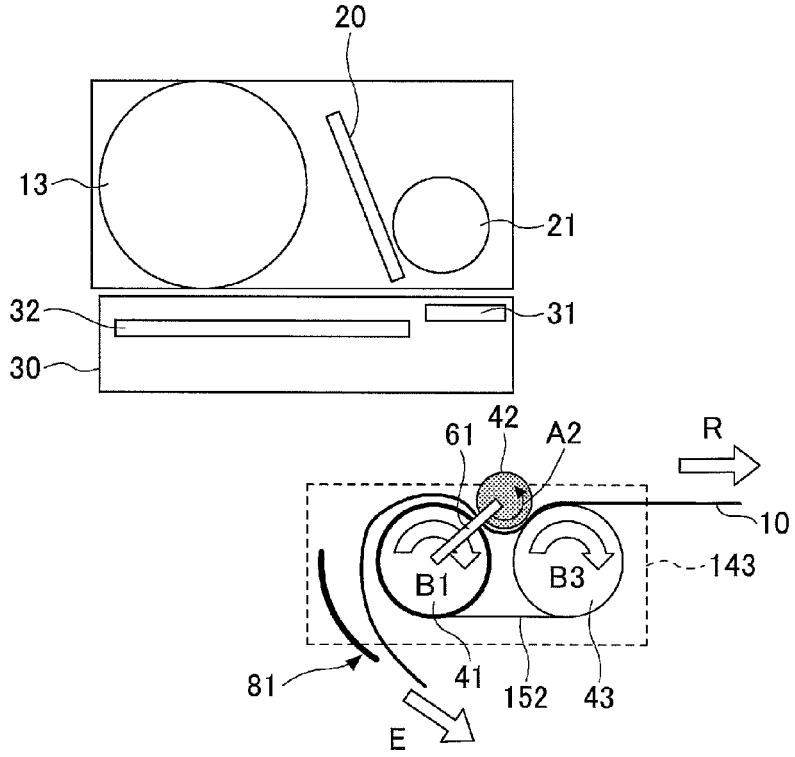

When recovering the printed recording paper 10, as shown in FIG. 17B, the drive roller 41 is rotated in the clockwise direction as shown by the arrow B1. At this time, the pinch roller 42 is moved along the outer periphery of the drive roller 41 in the clockwise direction. Then, the movement of the pinch roller 42 is stopped by the third roller 43 at the second rotating position. Thereafter, the pinch roller 42 is rotated in the counter-clockwise direction as shown by the arrow A2 in accordance with the rotation of the drive roller 41 at the second rotating position. Thus, the printed recording paper 10 is transferred by the pinch roller 42 and the second transfer belt 152 in the recovering direction R.

Alternative Example 4

An alternative example 4 of the embodiment is explained with reference to FIG. 18A and FIG. 18B.

The printer apparatus of the example includes a presenter unit 144 instead of the presenter unit 40, the presenter unit 140, the presenter unit 141, the presenter unit 142, or the presenter unit 143.

Figure 18A:
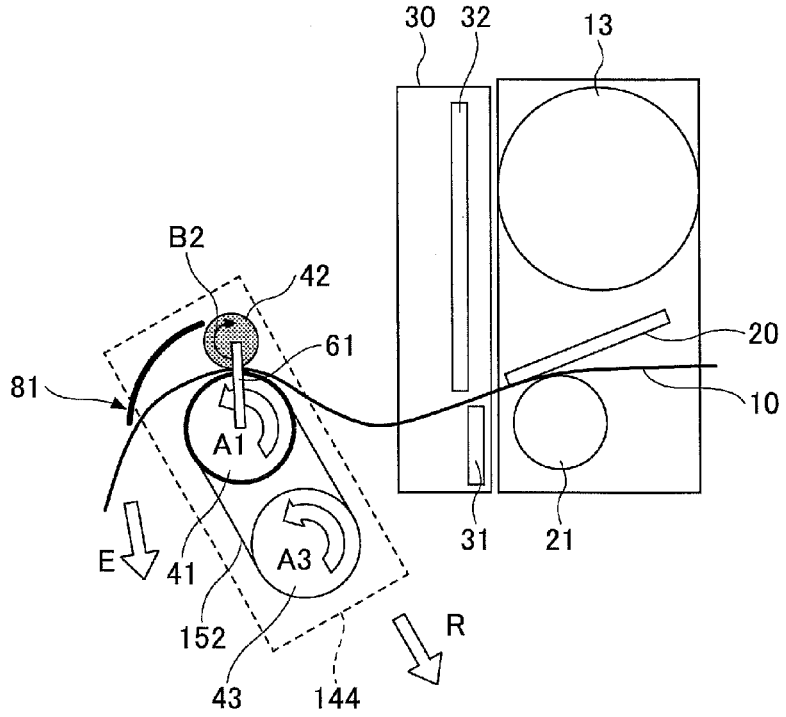
FIG. 18A and FIG. 18B are views for explaining another example of the operation of the presenter unit of the second embodiment.
Figure 18B:
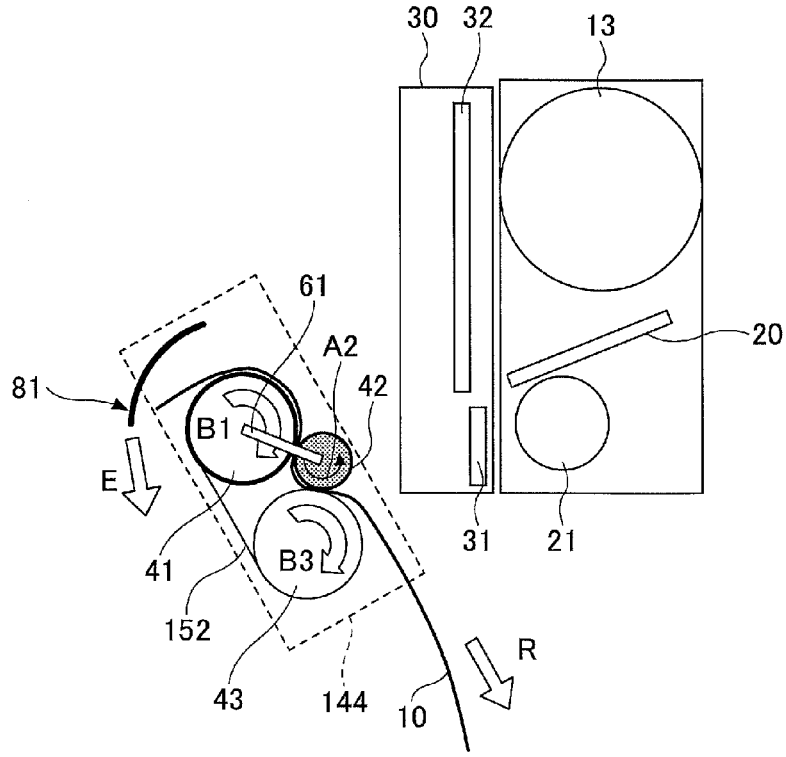

In the alternative example 4, as shown in FIG. 18A and FIG. 18B, the position of the presenter unit 144 with respect to the cutter unit (and the unit including the thermal head 20, the platen roller 21, the motor 13 and the like is different from that of the above examples. Thus, the printer apparatus 1 can be made in a desired shape.

When ejecting the printed recording paper 10, as shown in FIG. 18A similar to that explained with reference to FIG. 17A, the drive roller 41 is rotated in the counter-clockwise direction as shown by the arrow A1. At this time, the pinch roller 42 is rotated in the clockwise direction as shown by the arrow B2 in accordance with the rotation of the drive roller 41 at the first rotating position. Thus, the printed recording paper 10 is transferred by the pinch roller 42 and the second transfer belt 152 in the ejecting direction E.

When recovering the printed recording paper 10, as shown in FIG. 18B similar to that explained with reference to FIG. 17B, the drive roller 41 is rotated in the clockwise direction as shown by the arrow B1. At this time, the pinch roller 42 is rotated in the counter-clockwise direction as shown by the arrow A2 in accordance with the rotation of the drive roller 41 at the second stopping direction. Thus, the printed recording paper 10 is transferred by the pinch roller 42 and the second transfer belt 152 in the recovering direction R.

Alternative Example 5

Figure 19A:
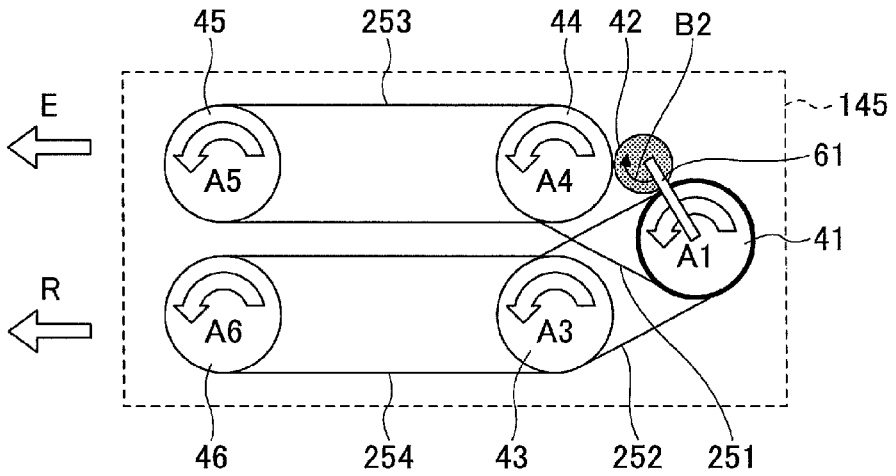
FIG. 19A and FIG. 19B are views for explaining another example of the operation of the presenter unit of the second embodiment.
Figure 19B:
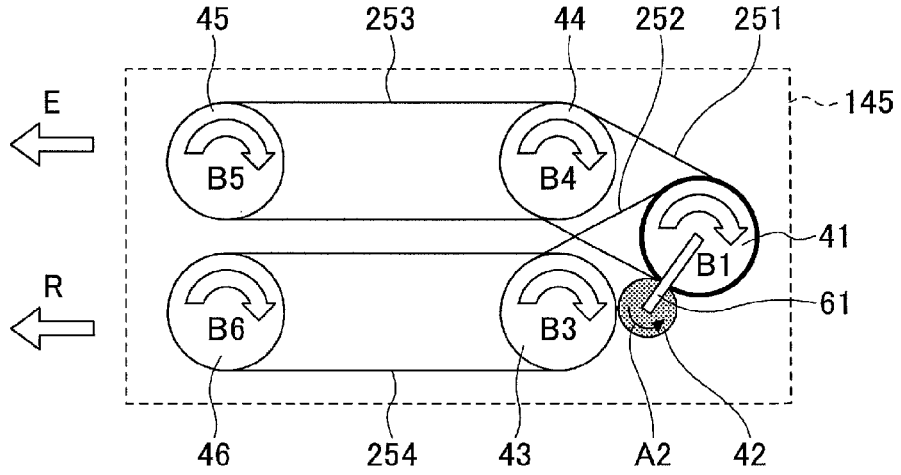

An alternative example 5 of the embodiment is explained with reference to FIG. 19A and FIG. 19B. In FIG. 19A and FIG. 19B the recording paper 10 is not shown.

The printer apparatus of the example includes a presenter unit 145 instead of the presenter unit 40, the presenter unit 140, the presenter unit 141, the presenter unit 142, the presenter unit 143, or the presenter unit 144.

In this example, the presenter unit 145 is configured such that the ejecting direction E and the recovering direction R are the same. The presenter unit 145 includes the drive roller 41, the pinch roller 42, the third roller 43, the fourth roller 44, the fifth roller 45, the sixth roller 46, the connection arm 61, a first transfer belt 251, a second transfer belt 252, a third transfer belt 253, and a fourth transfer belt 254. Although not shown in the drawings, the presenter unit 145 may further include pinch rollers to correspond to the fifth roller 45 and the sixth roller 46, respectively.

The first transfer belt 251 is hung around the drive roller 41 and the fourth roller 44. The second transfer belt 252 is hung around the drive roller 41 and the third roller 43. The third transfer belt 253 is hung around the fourth roller 44 and the fifth roller 45. The fourth transfer belt 254 is hung around the third roller 43 and the sixth roller 46.

When ejecting the printed recording paper 10, as shown in FIG. 19A, the drive roller 41 is rotated in the counter-clockwise direction as shown by the arrow A1. At this time, the pinch roller 42 is rotated in the clockwise direction as shown by the arrow B2 in accordance with the rotation of the drive roller 41 at the first rotating position. Thus, the printed recording paper 10 is transferred by the pinch roller 42, the first transfer belt 251 and the third transfer belt 253 in the ejecting direction E.

When recovering the printed recording paper 10, as shown in FIG. 19B, the drive roller 41 is rotated in the clockwise direction as shown by the arrow B1. At this time, the pinch roller 42 is moved to the second rotating position and is rotated in the counter-clockwise direction as shown by the arrow A2 in accordance with the rotation of the drive roller 41 at the second rotating position. Thus, the printed recording paper 10 is transferred by the pinch roller 42, the second transfer belt 252 and the fourth transfer belt 254 in the recovering direction R.

The structure of the printer apparatus of the second embodiment other than those explained above is similar to that of the first embodiment.

According to the embodiments, a printer apparatus and a method of controlling the printer apparatus capable of providing a presenter function of a high reliability with a small size are provided.

The individual constituents of the control substrate 12 may be embodied by arbitrary combinations of hardware and software, typified by a CPU of an arbitrary computer, memory, a program loaded in the memory so as to embody the constituents illustrated in the drawings, storage units for storing the program such as a hard disk, and an interface for network connection. It may be understood by those skilled in the art that methods and devices for the embodiment allow various modifications.

Although a preferred embodiment of the printer apparatus and the method of controlling the printer apparatus has been specifically illustrated and described, it is to be understood that minor modifications may be made therein without departing from the spirit and scope of the invention as defined by the claims.

The present invention is not limited to the specifically disclosed embodiments, and variations and modifications may be made without departing from the scope of the present invention.

What is claimed is:

1. A printer apparatus comprising:

a printing unit that prints an image on a recording paper;

a platen roller that transfers the recording paper;

a cutter unit that cuts the printed recording paper on which the image is formed by the printing unit; and a presenter unit configured to eject and recover the cut printed recording paper cut by the cutter unit, the presenter unit including a first roller that is rotated in a first direction for ejecting the cut printed recording paper and a second direction opposite to the first direction for recovering the cut printed recording paper, a second roller, a connection arm that connects the centers of the first roller and the second roller while pushing the second roller toward the first roller to have the second roller move along an outer periphery of the first roller in accordance with the rotation of the first roller between a first rotating position and a second rotating position, rotate at the first rotating position in accordance with the rotation of the first roller to transfer the cut printed recording paper in an ejecting direction while the cut printed recording paper is interposed between the first roller and the second roller when the first roller is rotated in the first direction, and rotate at the second rotating position in accordance with the rotation of the first roller to transfer the cut printed recording paper in a recovering direction while the cut printed recording paper is interposed between the first roller and the second roller when the first roller is rotated in the second direction, a third roller provided downstream of the first roller in the recovering direction, and a first transfer belt hung around the first roller and the third roller, and wherein the presenter unit is configured to transfer the cut printed recording paper by the second roller in the ejecting direction when the first roller is rotated in the first direction, and transfer the cut printed recording paper by the second roller and the first transfer belt in the recovering direction when the first roller is rotated in the second direction.

2. The printer apparatus according to claim 1, wherein the presenter unit further includes a fourth roller provided downstream of the first roller in the ejecting direction, a second transfer belt hung around the first roller and the fourth roller, and wherein the presenter unit is configured to transfer the cut printed recording paper by the second roller and the second transfer belt in the ejecting direction when the first roller is rotated in the first direction.

3. The printer apparatus according to claim 2, wherein the third roller and the fourth roller are configured to rotate in the first direction when the first roller is rotated in the first direction, and the third roller and the fourth roller are configured to rotate in the second direction when the first roller is rotated in the second direction.

4. The printer apparatus according to claim 2, wherein the presenter unit further includes a fifth roller provided further downstream of the fourth roller in the ejecting direction, the second transfer belt being held around the first roller, the fourth roller, and the fifth roller.

5. The printer apparatus according to claim 2, wherein the presenter unit further includes a sixth roller provided further downstream of the third roller in the recovering direction, the first transfer belt being held around the first roller, the third roller, and the sixth roller.

6. The printer apparatus according to claim 1, wherein the second roller is configured to move along the outer periphery of the first roller in the first direction when the first roller is rotated in the first direction, and move along the outer periphery of the first roller in the second direction when the first roller is rotated in the second direction.

7. The printer apparatus according to claim 1, wherein the second roller is configured to rotate in the second direction at the first rotating position when the first roller is rotated in the first direction, and rotate in the first direction at the second rotating position when the first roller is rotated in the second direction.

8. The printer apparatus according to claim 1, wherein the presenter unit further includes a first stopper member and a second stopper member to stop the movement of the second roller at the first rotating position and the second rotating position, respectively.

9. The printer apparatus according to claim 8, wherein at least one of the first stopping member and the second stopping member is a roller provided downstream of the first roller in the ejecting direction or in the recovering direction to be rotated in the same direction as that of the first roller.

10. The printer apparatus according to claim 1, wherein the connection arm is provided with a torque limiter.

11. The printer apparatus according to claim 1, wherein the presenter unit further includes a sensor for detecting the position of the cut printed recording paper.

12. A method of controlling the printer apparatus according to claim 1, comprising:

ejecting the cut printed recording paper by rotating the first roller in the first direction so that the second roller is rotated in accordance with the first roller at the first rotating position until a front end portion of the cut printed recording paper is transferred to a predetermined position while the back end portion of the cut printed recording paper is interposed between the first roller and the second roller, determining whether to perform a recovering operation after a predetermined period has passed from a timing when the cut printed recording paper is transferred to the predetermined position, and recovering the cut printed recording paper, when it is determined to perform the recovering operation, by rotating the first roller in the second direction so that the second roller is rotated in accordance with the first roller at the second rotating position.

13. The method of controlling the printer apparatus according to claim 12, wherein in the ejecting, the second roller is rotated in the second direction, and in the recovering, the second roller is rotated in the first direction.

14. A printer apparatus comprising:

a printing unit that prints an image on a recording medium; and a presenter unit configured to eject and recover the recording medium, the presenter unit including a first roller that is rotated in a first rotating direction when ejecting the recording medium, and that is rotated in a second rotating direction opposite to the first rotating direction when recovering the recording medium, a second roller, a connection arm that connects the centers of the first roller and the second roller to have the second roller move along an outer periphery of the first roller between a first rotating position and a second rotating position, a first transfer unit provided downstream of the first roller in a first direction that transfers the recoding medium in the first direction, and a second transfer unit provided downstream of the first roller in a second direction opposite to the first direction, that transfers the recording medium in the second direction, wherein the second roller is moved to and rotated at the first rotating position, and the recording medium is interposed between the first transfer unit and the second roller while the first roller is rotated in the first rotating direction, when transferring the recording medium in the first direction, and the second roller is moved to and rotated at the second rotating position, and the recording medium is interposed between the second transfer unit and the second roller while the first roller is rotated in the second rotating direction, when transferring the recording medium in the second direction.

15. The printer apparatus according to claim 14, wherein the first transfer unit includes a third roller, and the second transfer unit includes a fourth roller.

* * * * *